US009285753B2

(12) United States Patent
Hirama

(10) Patent No.: US 9,285,753 B2
(45) Date of Patent: Mar. 15, 2016

(54) INFORMATION PROCESSING APPARATUS AND CONTROL PROGRAM

(71) Applicant: Oki Data Corporation, Tokyo (JP)

(72) Inventor: Masayuki Hirama, Tokyo (JP)

(73) Assignee: Oki Data Corporation, Tokyo (JP)

( * ) Notice: Subject to any disclaimer, the term of this patent is extended or adjusted under 35 U.S.C. 154(b) by 155 days.

(21) Appl. No.: 13/685,765

(22) Filed: Nov. 27, 2012

(65) Prior Publication Data

US 2013/0136459 A1 May 30, 2013

(30) Foreign Application Priority Data

Nov. 30, 2011 (JP) ..... 2011-262339

(51) Int. Cl.
*G03G 15/00* (2006.01)
*G03G 15/08* (2006.01)
*G03G 21/00* (2006.01)

(52) U.S. Cl.
CPC ..... *G03G 21/00* (2013.01); *G03G 15/556* (2013.01)

(58) Field of Classification Search
CPC ..... G03G 15/5091; G03G 21/1875; G03G 21/1896; G03G 21/1892; G03G 21/16; G03G 2215/0695
See application file for complete search history.

(56) References Cited

U.S. PATENT DOCUMENTS

2006/0034624 A1* 2/2006 Burchette ..... G03G 15/55 399/12
2006/0045546 A1* 3/2006 Okochi ..... G03G 15/553 399/13
2008/0104667 A1* 5/2008 Terada ..... H04L 63/08 726/2
2009/0132608 A1* 5/2009 Daos ..... G06Q 10/06
2010/0272452 A1* 10/2010 Tsukijima ..... G03G 15/553 399/27
2011/0058825 A1* 3/2011 Tsukijima ..... G03G 15/0868 399/27

(Continued)

FOREIGN PATENT DOCUMENTS

JP 09264659 A * 10/1997
JP 2007-017724 A 1/2007
JP 2007271884 A * 10/2007

OTHER PUBLICATIONS

JP_2007017724_A_I Machine Translation.*
JP_2007271884_A_T Machine Translation.*

(Continued)

*Primary Examiner* — Clayton E Laballe
*Assistant Examiner* — Victor Verbitsky
(74) *Attorney, Agent, or Firm* — Muncy, Geissler, Olds & Lowe, P.C.

(57) ABSTRACT

An information processing apparatus includes a maintenance staff information store part that stores maintenance staff identification information, a maintenance staff authentication part that determines an authentication success when identification information, which is input from an operation panel, is identical to the maintenance staff identification information, a maintenance history store part that, when a replacement of a consumable item is performed, stores the maintenance staff identification information as well as information of the consumable item that was used before the replacement, and an output part that outputs the maintenance staff identification information that was authenticated at the time of the replacement of the consumable item as well as the information of the consumable item that is stored in the maintenance history store part, the consumable item being used before the replacement.

12 Claims, 16 Drawing Sheets

(56) References Cited

U.S. PATENT DOCUMENTS

| | | | | |
|---|---|---|---|---|
| 2011/0129238 | A1* | 6/2011 | Muranaka | G03G 21/1892 399/12 |
| 2012/0134686 | A1* | 5/2012 | Jones | G03G 21/1892 399/12 |

OTHER PUBLICATIONS

JP_2007017724_A_I Machine Translation, Japan, Abe, Jan. 2007.*

JP_2007271884_A_T Machine Translation Japan, Makajima et al., Oct. 2007.*

* cited by examiner

| Toner Color | C | M | Y | K |
|---|---|---|---|---|
| The Number of Printable Images | 2500 | 7000 | 7000 | 2500 |
| Replacement Flag | 1 | 0 | 0 | 0 |

| Toner Color | C | M | Y | K |
|---|---|---|---|---|
| The Number of Printable Images | 2500 | 7000 | 7000 | 2500 |
| RFID | 2420 | 5100 | 4300 | 2120 |
| Replacement Flag | 1 | 0 | 0 | 0 |

| Maintenance Staff ID |
|---|
| KK07945 |
| KJ5587 |

Fig. 19

| Toner Color | The Number of Outputable Images | Count at the Time of Replacement | Authentication Date | Maintenance Staff ID |
|---|---|---|---|---|
| Y | 2500 | 2400 | 2011/2/10 | KK027945 |
| K | 7500 | 4350 | 2011/2/10 | KK027945 |
| C | 2500 | 2420 | 9999/99/99 | |

Fig. 20

* Consumable Item Management Report *

| Toner Color | The Number of Outputable Images | Count at the Time of Replacement | Authentication Date | Maintenance Staff ID |
|---|---|---|---|---|
| Y | 2500 | 2400 | 2011/2/10 | KK027945 |
| K | 7500 | 4350 | 2011/2/10 | KK027945 |
| C | 2500 | 2420 | 2011/3/10 | KJ55879 |

INFORMATION PROCESSING APPARATUS AND CONTROL PROGRAM

CROSS REFERENCE

The present application is related to, claims priority from and incorporates by reference Japanese patent application number 2011-262339, filed on Nov. 30, 2011.

TECHNICAL FIELD

The present application relates to an information processing apparatus and a control program, and can be applied to an image forming apparatus such as a printer including, for example, a plurality of consumable items (for example, a plurality of toners (toner cartridges)).

BACKGROUND

For a conventional electrographic printer (image forming apparatus), JP Laid-Open Patent Application No. 2007-17724 discloses a technology that allows a user to properly replace a consumable item such as a toner for efficient usage of the consumable item.

In the technology disclosed in JP Laid-Open Patent Application No. 2007-17724, information for notifying the user of time to replace based on the consideration of a toner usage amount and a remaining amount thereof is output.

However, in a case where the conventional technology is applied to a color printer including plural colors of toners, when there is at least one toner to be replaced (toner with a small remaining amount), there is a possibility that a user (for example, an end user, a maintenance operation staff, etc.) may mistakenly replace a toner that is unnecessarily to be replaced (for example, toner with a sufficient remaining amount (life)). Also in a case of the conventional color printer, there is a possibility that a toner that is unnecessarily to be replaced may be replaced when another toner that is to be replaced is replaced.

Especially in a case of a conventional color printer to which so called a pay-as-you-go system that is a charge system based on the number of printed amounts (sheets), etc. is applied, there is a disadvantage that a maintenance staff replaces a toner unnecessarily to be replaced with a new one (new toner) only because it is a good opportunity for the maintenance staff to provide a service.

Therefore, for an information processing apparatus (for example, image forming apparatus such as a printer) including a plurality of consumable items (for example, toners, etc,), an information processing apparatus and control program that can promote efficient usage of the consumable items by a user are desired.

SUMMARY

Considering the above subjects, an information processing apparatus that is one of disclosed inventions in the present application includes a maintenance staff information store part that stores maintenance staff identification information, a maintenance staff authentication part that determines an authentication success when identification information, which is input from an operation panel, is identical to the maintenance staff identification information, a maintenance history store part that, when a replacement of a consumable item is performed, stores the maintenance staff identification information as well as information of the consumable item that was used before the replacement, and an output part that outputs the maintenance staff identification information that was authenticated at the time of the replacement of the consumable item as well as the information of the consumable item that is stored in the maintenance history store part, the consumable item being used before the replacement.

According to the present application, in an information processing apparatus including a consumable item, it is possible to promote efficient usage of the consumable item by a user.

BRIEF DESCRIPTION OF THE DRAWINGS

FIG. 19 is an explanatory view of a content example of a maintenance history management table recorded in a maintenance history store part according to the second embodiment.

FIG. 20 is an explanatory view of a content example of a report generated by a report creation part according to the second embodiment.

DETAILED DESCRIPTION OF THE EMBODIMENTS (A) First Embodiment

Hereinafter, an information processing apparatus and control program according to a first embodiment of the present application is described in detail with reference to the drawings. Note, the information processing apparatus according to the first embodiment is a printer.

(A-1) Configuration of First Embodiment

Figure 1:
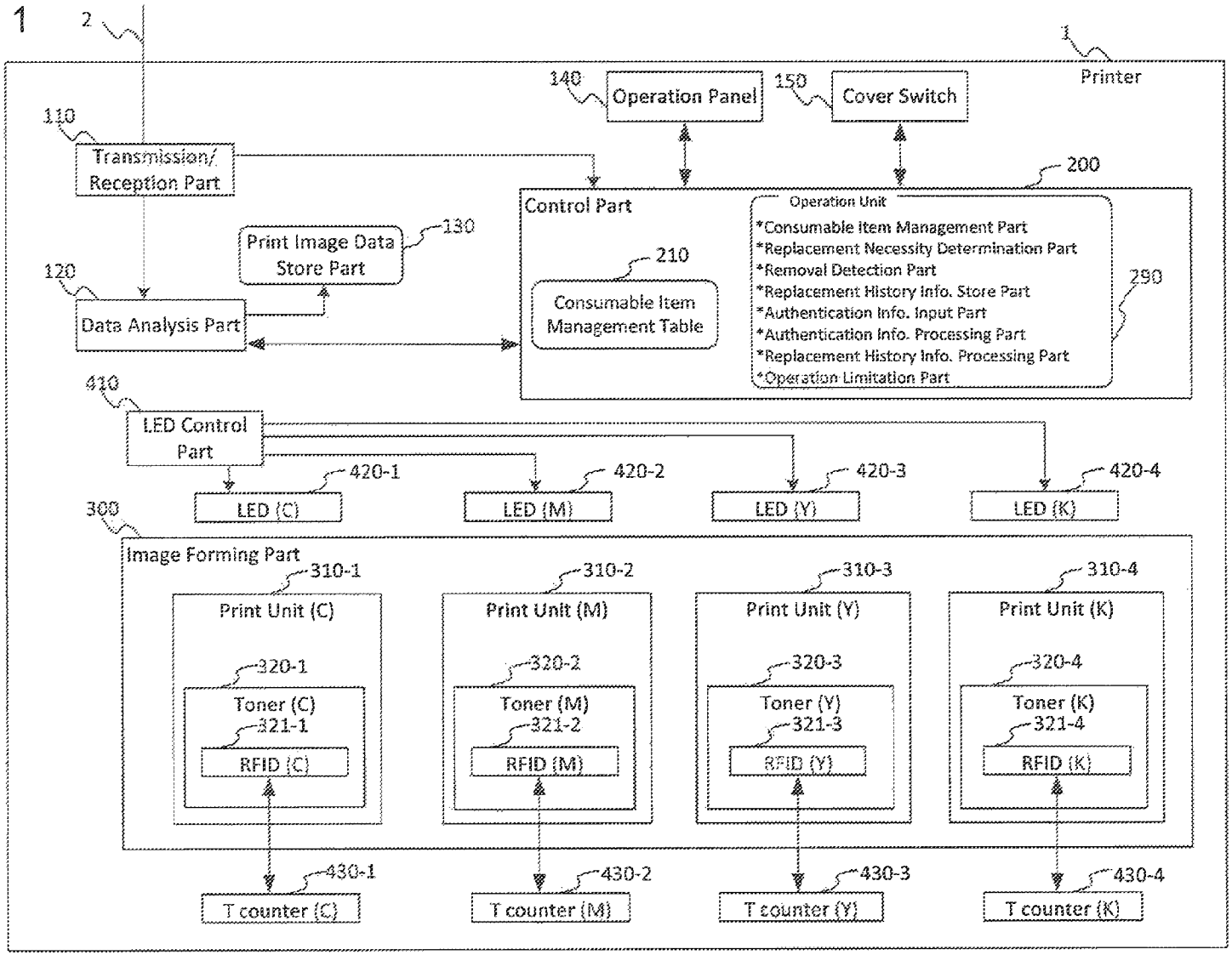
FIG. 1 is a block diagram of a functional configuration of a printer according to a first embodiment.

FIG. 1 is a block diagram of a functional configuration of a printer 1 according to this embodiment.

The printer 1 includes a transmission/reception part 110, a data analysis part 120, a print image data store part 130, an operation panel 140, a cover switch 150, a control part 200, an image forming part 300, a LED control part 410, four LEDs 420 (420-1 through 420-4), and four T counters 430 (430-1 through 430-4).

The transmission/reception part 110 is an interface for connecting the printer 1 with a network, etc., via a communication line 2. A type of an interface compatible with the transmission/reception part 110 is not limited; however, for example, interfaces compatible with Ethernet (registered trademark) and universal serial bus (USB), etc., are applicable. The transmission/reception part 110 receives a print job data from a host device (hereinafter, may also be referred to as "host") such as a PC via the communication line 2, and forwards to the data analysis part 120. Also, the transmission/reception part 110 receives a control signal (for example, alert information about a consumable item, etc.) transmitted from the control part 200 to a predetermined host, and also performs a process to transmit the control signal to the host.

The data analysis part 120 performs a process of receiving the print job data from the transmission/reception part 110, analyzing the print job data and changing to image data, and storing in the print image data store part 130 and notifying to the control part 200. The print image data store part 130 is a memory part that stores image data generated by the data analysis part 120 as described above. Because, for example, a process similar to a process applied to a conventional printer can be used as a generation process of image data executed by the data analysis part 120, a detail explanation thereof is omitted.

The control part 200 has functions of controlling various configuration elements of the printer 1, and has a consumable item management table 210. The detail of the consumable item management table 210 is described later. The above functions are listed in an operation unit 290, for example, below:

*Consumable Item Management Part
*Replacement Necessity Determination Part
*Removal Detection Part
*Replacement History Info. Store Part
*Authentication Info. Input Part
*Authentication Info. Processing Part
*Replacement History Info. Processing Part
*Operation Limitation Part Also, the control part 200 may be architected by installing a control program of the embodiment, etc, in a program execution configuration such as, for example, CPU, ROM, RAM, EEPROM, and a hard disk.

The image forming part 300 includes four print units 310 (310-1 through 310-4). The four print units 310 (3104 through 310-4) have substantially the same configuration. Hereinafter, for the sake of simple description, the print units 310 may be described in singular mode, but it should be noted that a description of one of the print units 310 in singular mode is also applied to the other three print units 310. The print unit 310 performs a process of forming an image based on the print image data supplied from the control part 200 on a medium (print sheet). Specifically, the print unit 310 performs a. process of developing the print image data supplied from the control part 200, transferring to a sheet of a specified size, and executing thermal fusion and outputting. The print units 310-1 through 310-4 are arranged as print units that respectively correspond to toner colors of cyan (hereinafter, may be referred to as "C"), magenta (hereinafter, may be referred to as "M"), yellow (hereinafter, may be referred to as "Y"), and black (hereinafter, may be referred to as "K"). The print units 310 (310-1 to 310-4) respectively include the color toners (320-1 to 320-4) that are consumed during the image forming process. The toners 320 having different colors (CMYK) are respectively filled in corresponding toner cartridges. Each of the print units 310 for the color toilers (CMYK), of which the toner has been consumed, can be replaced or supplied with new toners by a replacement with a new toner cartridge that is filled with the same color toner.

Then, the toner 320 (320-1 through 320-4) includes one of radio frequency identifications (hereinafter, referred to as "RFID") 321 (321-1 through 321-4) attached to a periphery thereof (for example, a periphery of a bottle filled with a toner). The RFIDs 321 (321-1 through 321-4) have substantially the same configuration. Hereinafter, for the sake of simple description, the RFIDs 321 may be described in singular mode, but it should be noted that a description of one of the RFIDs 321 in singular mode is also applied to the other RFIDs 321. The RFID 321 is a recording medium on which a parameter related to a usage amount (consumption amount) or remaining amount of the toner 320. A type of the parameter recorded on the RFID 321 is not limited; however, a parameter (hereinafter, may also be referred to as "toner usage amount") for showing the usage amount of the toner 320 is indicated by a unit used to explain the number of print pages (the number of print sheets in a predetermined size) that have already been printed and output by using the toner 320. The number of print pages, which is described above, may be a value converted by the number of dots when a printing is performed in a predetermined density to a print sheet in a predetermined size (for example, a A4 size print sheet). For example, in a case where a printing is performed in a predetermined density to one sheet of A4 size print sheet, a total value of the number of dots is 10000 dots. In this case, a conversion of 500000 [dots]=50 [ sheets] is obtained.

Note, a detail description of configurations of the print unit 310 and toner 320 (including the RFID 321 attached) is omitted because a print unit and a toner similar to ones used in a conventional color printer are applicable. Also, in the image forming part 300, the number of the print units 310 to be arranged and a combination of color types of the toners 320 are not limited to the above-described example. Also, a type of the parameter related to the toner usage amount (or toner remaining amount) recorded on the REID 321 of the toner 320 is not also limited to the above-described example, and various configurations of a conventional printer and a toner cartridge are applicable.

Then, on a side of a main body of the printer 1, T counters 430 (430-1 through 430-4) respectively corresponding to the toners 320-1 through 320-4 (RFIDs 321-1 through 321-4) are provided. The T counters 430(430-1 through 430-4) have substantially the same configuration. Hereinafter, for the sake of simple description, the T counters 430 may be described in singular mode, but it should be noted that a description of one of the T counters 430 in singular mode is also applied to the other T counters 430. The T counter 430 performs a process of communicating the corresponding RFID 32.1 in response to a control of the control part 200 and updating the parameter (toner usage amount) recorded on the RFID 321. Note, a detail description of the T counter 430 is omitted because a T counter similar to one used in a printer including a conventional toner (toner cartridge) to which a RFID is attached is applicable, The T counter 430 performs a process of obtaining the number of dots from a video signal, etc. of print image data supplied from the control part 200 to the image forming part 300 (print unit 310), performing a wireless communication with the corresponding RFID) 321, and adding a value obtained by converting the obtained number of dots to the number of print sheets to the parameter of the toner usage amount recorded on the RFID 321. Also, the T counter 430 performs a process of responding to the control part 200 in response to a control of the control part 200 with reference to a value of the toner usage amount recorded on the corresponding RFID 321.

In other words, the control part 2.00 performs as a consumable item management part that manages toner usage amounts of the toners 320 (consumable item) using the T counters 430.

The cover switch 150 detects whether a cover 160 of the printer 1 is in an opened state or a closed state, and notifies a detected content to the control part 200.

Figure 2B:
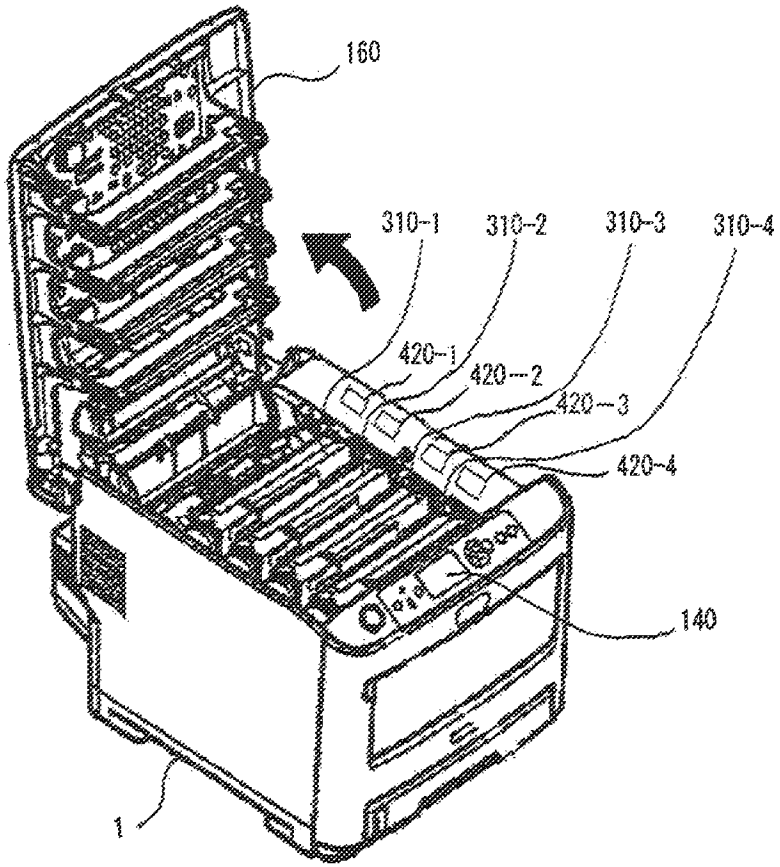
FIG. 2A and FIG. 2B are perspective views of the printer according to the first embodiment.
Figure 2A:
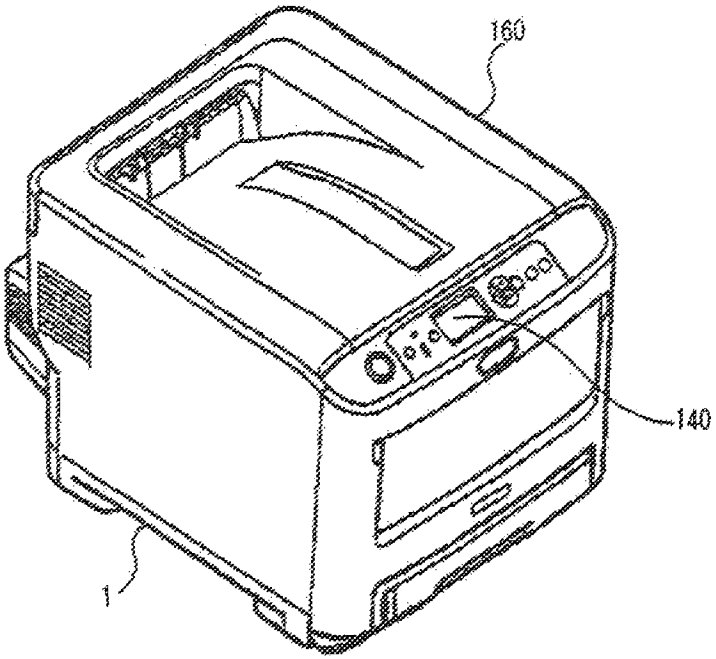

FIG. 2A and FIG. 2B are perspective views of the image forming part 300 in the printer 1. FIG. 2A is a perspective view of a case where the cover 160 covering the image forming part 300 in the printer 1 is in a closed state. Also, FIG. 2B is a perspective view of a case where the cover 160 covering the image forming part 300 in the printer 1 is in an opened state (hereinafter, may also be referred to as "cover-opened").

The cover switch 150 may be configured as, for example, a switch turned ON or OFF depending on the opened-closed state of the cover 160. It is explained that the opened state and closed state of the cover 160 of the printer 1 are detected by using the cover switch 150. However, another sensor (for example, an optical sensor) used in a conventional printer may be also applicable.

LEDs 420 (420-1 through 420-4) are light sources of lamps that respectively light (for example, starting lighting, stopping lighting, blinking) based on a control from the LED control part 41.0. The LEDs 420 (420-1 through 420-4) have substantially the same configuration. Hereinafter, for the sake of simple description, the LEDs 420 may be described in singular mode, but it should be noted that a description of one of the LEDs 420 in singular mode is also applied to the other LEDs 420. The LEDs 420-1 through 420-4 perform as display lamps that show states of the toners 320-1 through 320-4. In other words, the LED 420 performs as a part that displays and outputs a state of the toner usage amount (or toner remaining amount) of the corresponding toner 320. Note, the LED control part 410 may also be configured as a part of the control part 200 and may also be architected as a semiconductor device, such as a circuit, that is independent from the control part 200.

As illustrated in FIG. 2, which is mentioned above, in the printer 1, the print units 310 respectively including the toners 320 are arrayed, and the LEDs 420 are respectively arranged in the vicinities of the corresponding toners 320 (print units 3 10). In other words, the LED 420 performs as a display part that displays a state of the corresponding toner 320 (print unit 310). For example, in the vicinity of the print unit 310-1 including the toner 320-1, the LED 420-1 is arranged. Note, an arrangement position of the LED 420 is not limited as long as a user can figure out a correspondence between the print unit 310 (toner 320) and the LED 420 from the arrangement position.

Note, it is explained that the LED lamp is used as the display part that displays and outputs a state of the toner 320 in the present embodiment. However, the LED lamp may also be replaced with another part such as a small-size liquid crystal display and a fluorescent lamp, etc. Also, the display part that displays and outputs a state of the toner 320 is not always necessarily to include a light source, and also may simply perform a liquid crystal display (for example, may also display numbers such as "1", "0", etc, and a massage such as "replacement required", etc.). In other words, a specific system of the display part that displays and outputs a state of the toner 320 is not limited as long as a state of the toner 320 can be notified to a user. In addition, a single display unit may realize the same functions of the display parts.

Also, in the present embodiment, the LED 420 is configured such that the LED 420 cannot be seen (not observable) unless the cover 160 is in the opened state. However, the LED 420 may also be configured to be seen (observable) also when the cover 160 is in the closed state. For example, a configuration is also applicable in which a penetration hole or a waveguide (for example, light fiber, etc.) is provided in a portion that covers the LED 420 on a cover 160 side in the closed state. With the configuration, even when the cover 160 is in the closed state, a state of the LED 420 is confirmable from the outside by a user.

The operation panel 140 performs as an interface with a user. A type of a device used as the operation panel 140 that is an interface with a user is not limited. However, here, a device such as a touch panel screen, etc. using a display (for example, liquid crystal display) is used. Note, because a panel similar to one used for a conventional printer can be used as the operation panel 140, a detail explanation thereof is omitted. Also, according to the description of the operation panel 140 of the present embodiment, a touch panel screen is used to receive an operation by a user and display information for a user. However, a hardware key may also be used to receive an operation by a user.

Next, a content of the consumable item management table 210 managed by the control part 200 is explained.

Figures 6, 7:
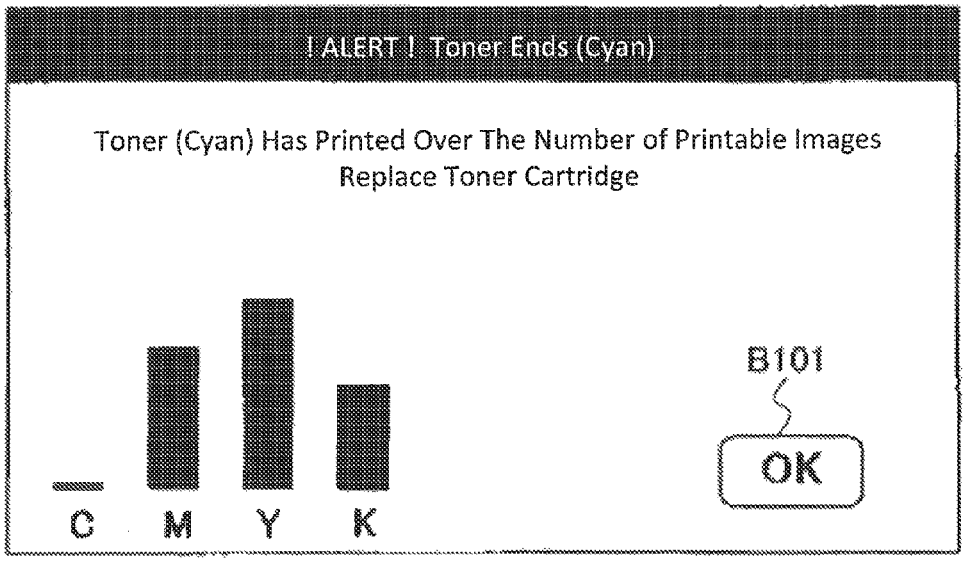
FIG. 6 is an explanatory view of a content example of a consumable item management table according to the first embodiment.
FIG. 7 is an explanatory view of an example of a toner replacement request screen displayed and output by the printer according to the first embodiment.

FIG. 6 is an explanatory view of a content example of the consumable item management table 210.

In the consumable item management table 210, the number of printable images and information of a replacement flag are stored for each of the toner colors (toner 320).

In FIG. 6, toner colors corresponding to the toners 320-1 through 320-4 are shown as C, M, Y, and K. For example, a toner color corresponding to the toner 320-1 is C.

An item of "the number of printable images" indicates the upper limit (consumption limit) number (hereinafter, may also be referred to as "toner end value") of printable images of the toner 320 of each of the corresponding colors.

A method for the control part 200 to hold the toner end value is not limited; however, for example, a previously registered value may be applied, and a method in which the toner end value is memorized on the RFID 321 of each of the toners 320 to read that from the MD 321 may also be applicable.

An item of "replacement flag" indicates a flag for managing whether or not a replacement of the toner 320 of each of the corresponding toner colors is required. In the control part 200, based on a condition of the number of printable images, etc, necessity of replacement of each of the toner colors (toner 320) is determined, and a replacement flag of a toner color (toner 320) determined as a replacement thereof is necessary is changed. In the present embodiment, a "replacement flag" for a toner color (toner 320) that should be replaced is displayed as "1", and a "replacement flag" for a toner color (toner 320) that shouldn't be replaced is displayed as "0."

In the present embodiment, when a toner usage amount of at least one of the colors (toner 320) is less than a predetermined threshold value (hereinafter, toner near end value), the control part 200 sets the replacement flag of the toner color (toner 320) to be "1." Then, when the toner color (toner 320) is replaced with a toner 320 whose number of printable images is a predetermined toner near end value or more, the control part 200 sets the replacement flag of the toner color to be "0." In other words, the control part 200 also performs as a replacement necessity determination part that determines the necessity of replacement of the toners 320 (consumable items).

A method how the control part 200 holds a toner near end value is not limited; however, the holding may also be performed by a calculation of multiplying a toner end value by a predetermined coefficient k ($0<k<1$).

Also, the control part 200 controls the LED control part 410 so as to start lighting of the LED 420 corresponding to the toner color (toner 320) whose replacement flag is "1". Then, when a removal (or replacement) of the toner 320 corresponded to the lighted LED 420 is detected, the control part 200 controls the LED control part 410 so as to stop the lighting of the LED 420 corresponding to the toner 320. In other words, in the printer 1, the control part 200 and the LED control part 410 perform as display control parts that perform a lighting control of the LEDs 420. Also, the control part 200 performs as a removal detection part.

Note, a content of the lighting control of each of the LEDs 420 need only be able to display content different by a necessity of replacement (content of the replacement flag). For example, a LED 420 corresponding to a toner color (toner 320) whose replacement flag is "1" stops itself from lighting and a LED 420 corresponding to a toner color (toner 320) whose replacement flag is "0" starts its lighting.

Furthermore, when a removal of the toner 320 whose corresponding LED 420 is not lighted (in other words, the toner 320 whose replacement flag is not "1") is detected, the control part 200 controls the LED control part 410 such that the LED 420 corresponding to the toner 320 blinks at a predetermined interval. Note, the content of the lighting control for a LED 420 when a toner 320 whose replacement flag is not "1" is removed needs only be a third display content that is different from either a first display content (starting of lighting in the above-described example) for the case that the replacement flag is "1", or a second display content (stopping of lighting in the above-described example) for the case that the replacement flag is "0." For example, when LEDs 420 are a plurality of colors of light sources and when a replacement flag is "1", lighting of a first color light source may start, and when a toner 320 whose replacement flag is not "1" is removed, lighting of a second color light source may start.

Moreover, the control part 200 controls the operation panel 140 and outputs to display a predetermined content (to be explained later in detail) when a toner 320 whose number of printable images is less than the toner near end value exists or when a toner 320 whose number of printable images is less than the toner end value that is smaller than the toner near end value exists.

(A-2) Operation of First Embodiment

Next, an operation of the printer 1 according to the first embodiment, which has the configuration as described above, is explained.

Figure 3:
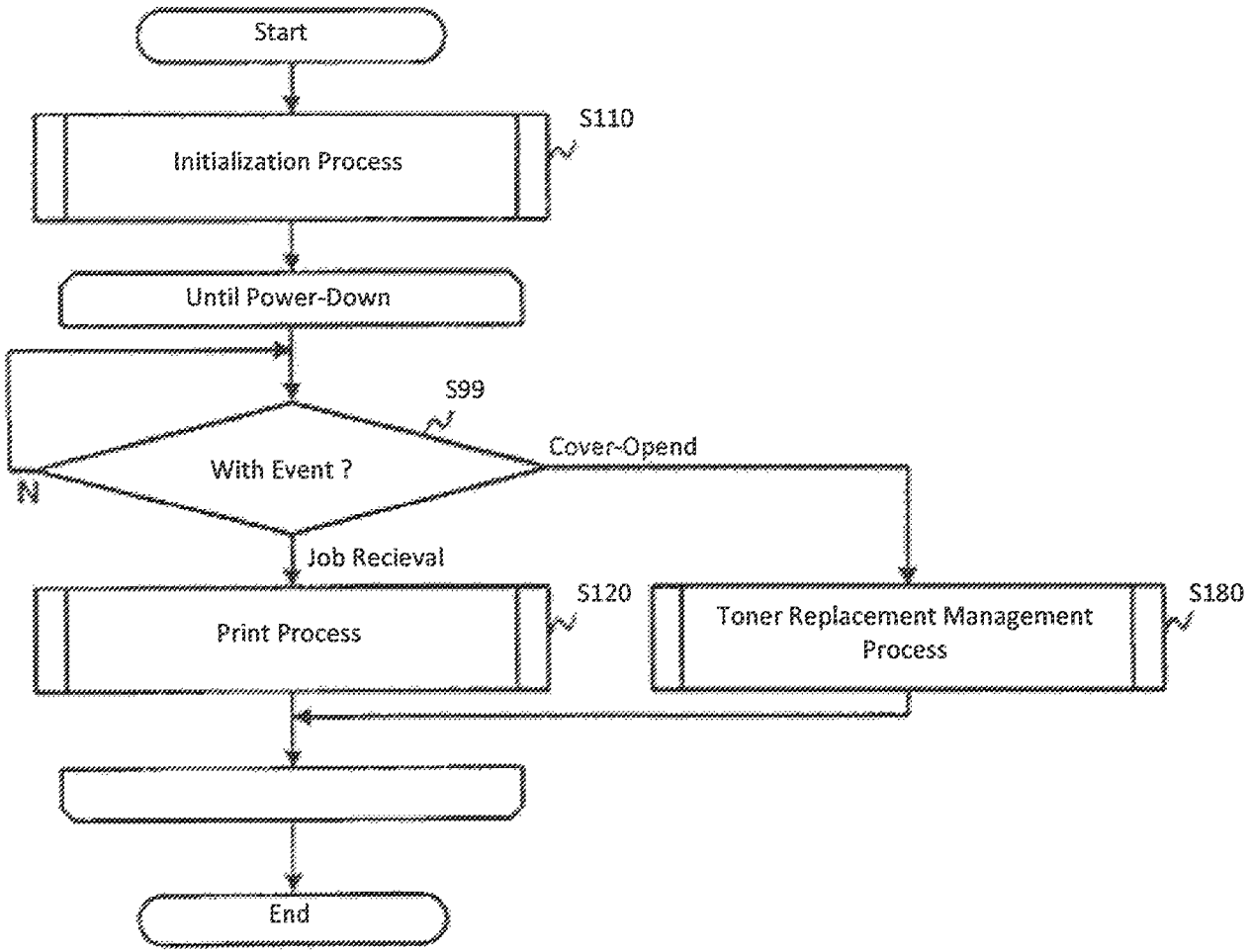
FIG. 3 is a flow diagram of entire processes for toner management executed by the printer according to the first embodiment.

FIG. 3 is a flow diagram of entire processes (processes executed by the control part 200) for toner management of the printer 1.

In response to power-up of the printer 1, the control part 200 executes an initialization process (S110). Note, the detail of the initialization process (S110) is described later.

Then, when an event occurs, the control part 200 executes a process corresponding to the event until power-down (S99).

The printer 1 executes a print process (S120) when an event of receiving a print job occurs. Also, the printer 1 executes a toner replacement management process (S180) when an event of cover-opened (detection of cover-opened by the cover switch 150) occurs. Note, a process of the print process event (S120), which is described above, and the toner replacement management process (S180), which is described above, are described in detail later.

Figure 4:
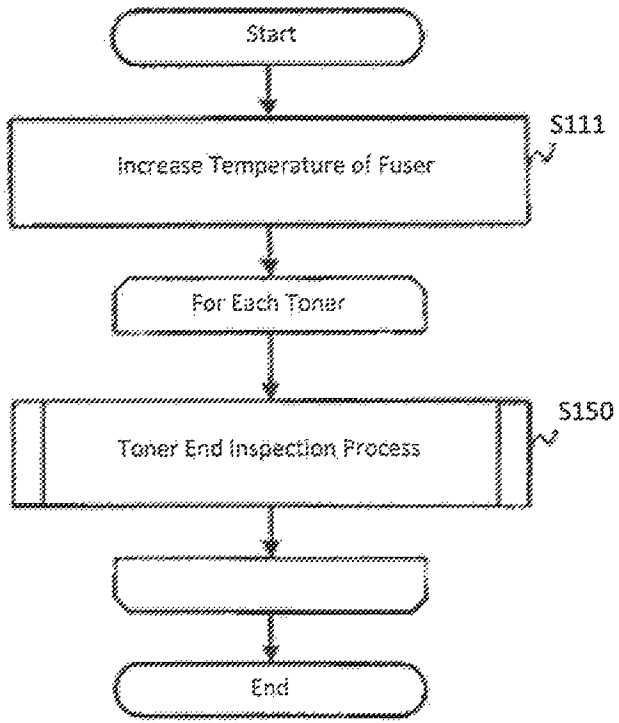
FIG. 4 is a flow diagram of detail of an initialization process executed by the printer according to the first embodiment.

Next, a detail of the initialization process (process executed by the control part 200) (S110) described above is explained using the flow diagram of FIG. 4.

In response to power-up of the printer 1, the control part 200 commands the image forming part 300 to execute a warm-up process (S111) by increasing temperature of a fuser (not shown) configuring the image forming part 300 to a predetermined temperature, etc.

Then, the control part 200 executes a toner end inspection process (S150) for each of the toners 320-1 through 320-4, and ends the initialization process. The toner end inspection process (S150) includes a confirmation process of a toner usage amount, etc.

Next, the toner end inspection process (S150) described above is explained using FIG. 5.

Figure 5:
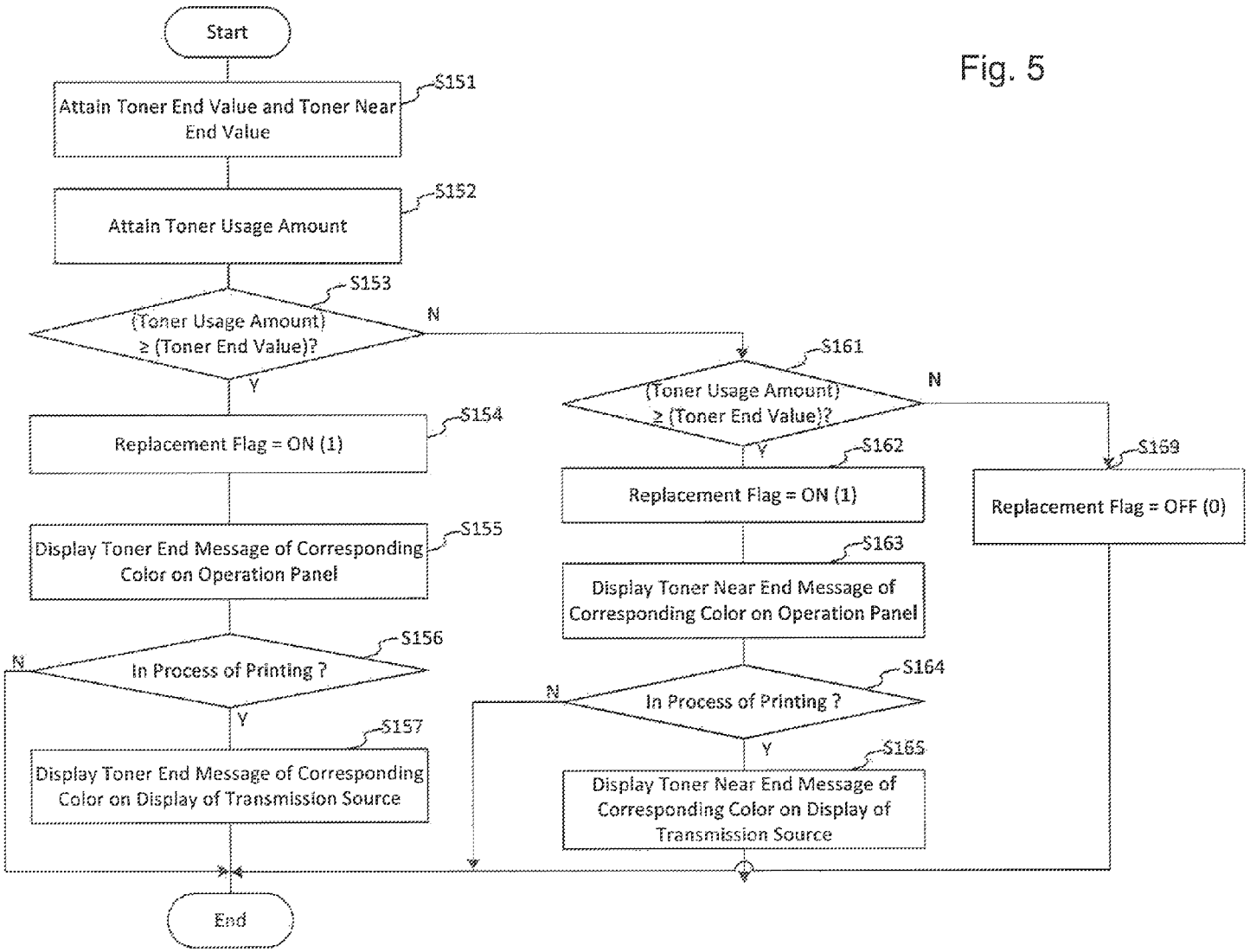
FIG. 5 is a flow diagram of a toner end inspection process executed by the printer according to the first embodiment.

In the toner end inspection process, the control part 200 executes a process of updating the content of the consumable item management table 210 based on the situation of the mounted toner 320 for each of the toner colors. The control part 200 executes the toner end inspection process illustrated in. FIG. 5 for each of the toners 320-1 through 320-4. Hereinafter, an example in a case when the toner end inspection process for the toner 320-1 whose toner color is cyan (C) is explained. Because the same process is applicable to the other toners 320-2 through 320-4, an explanation for the process for the other toners is omitted.

When the toner end inspection process for the toner 320-1 starts, the control part 200 holds a toner near end value and toner end value of the toner 320-1 (S151). Also, the control part 200 may update the consumable item management table 210 (item of the number of printable images) based on the held toner near end value. As described above, the method how the control part 200 holds the toner near end value and toner end value for each of the toners 320 is not limited.

Next, the control part 200 attains a parameter value of a toner usage amount recorded on the RFID 321-1 attached to the toner 320-1 via the T-counter 430-1 (S152).

Then, the control part 200 compares the toner usage amount for the toner 320-1 with the toner end value for the toner 320-1 (S153). When the toner usage amount is the toner end value or more, the control part 200 processes an operation of S154, which is described later. When it is not, the control part 200 processes an operation of S161, which is described later.

When the toner usage amount is the toner end value or more in S153 described above, the control part 200 updates the replacement flag (cell in the "replacement flag" row and in a toner color "C" column) corresponding to the toner 320-1 to "1", which means ON, in the consumable item management table 210 (S154), and displays a predetermined alert (hereinafter, referred to as "toner replacement request screen") on an operation panel 140, Note, the detail of the toner replacement request screen is explained later.

Also, when the toner replacement request screen is displayed on the operation panel 140, the control part 200 confirms whether or not the image forming part 300 is in process of printing to a print sheet. Then, when it is confirmed that the image forming part 300 is in process of printing, the content the same as that of the toner replacement request screen is transmitted to a host side (for example, a PC, etc.) of a job transmission source to display the content on the display of the host (S156, S157), and ends the toner end inspection process for the toner 320-1. Note, when the toner end inspection process is executed during the initialization process, the image forming part 300 is never in process of printing, so that in that case the process of S157 (display of the toner replacement request screen in the host side) is not executed.

In S153 described above, when the toner usage amount is less than the toner end value, the control part 200 compares the toner usage amount for the toner 320-1 with the toner near end value for the toner 320-1 (S161). When the toner usage amount is the toner near end value or more, the control part 200 processes an operation of S162, which is described later, and when it is not, the control part 200 processes an operation of S169, which is described later.

When the toner usage amount is the toner near end value or more in S161 described above, the control part 200 updates the replacement flag (cell in the "replacement flag" row and in a toner color "C" column) corresponding to the toner 320-1 to "1", which means ON, in the consumable item management table 210 (S162), and displays the content the same as that of the above-described toner replacement request screen as a predetermined alert on the operation panel 140 (S163).

Also, when the control part 200 displays the toner replacement request screen on the operation panel 140, the control part 200 confirms whether or not the image forming part 300 is in process of printing to a print sheet. Then, when it is confirmed that the image forming part 300 is in process of printing, the content the same as that of the toner replacement request screen is transmitted to the host side (for example, a PC, etc.) of the job transmission source to display the content on the display of the host (S164, S165), and ends the toner end inspection process for the toner 320-1. Note, when the toner end inspection process is executed during the initialization process, the image forming part 300 is never in process of printing, so that in that case the process of S165 (display of the toner replacement request screen in the host side) is not executed.

On the other hand, when the toner usage amount is less than the toner near end value in S161 described above, the control part 200 updates the replacement flag (cell in the "replacement flag" row and in a toner color "C" column) corresponding to the toner 320-1 to "0", which means OFF, in the consumable item management table 210 (S169), and ends the toner end inspection process. Note, the control part 200 may not execute an updating process especially when the "replacement flag" is already "0."

FIG. 7 is an explanatory view of an example of a toner replacement request screen displayed on the operation panel 140 when the toner 320 is toner end or toner near end.

FIG. 7 illustrates the toner replacement request screen that the control part 200 commands to display on the operation panel 140 when the toner 320-1 whose toner color is cyan (C) is detected as toner end or toner near end.

The toner replacement request screen illustrated in Fig, 7 displays a message "toner (cyan) has printed over the number of printable images. Replace toner cartridge", etc. FIG. 7 illustrates an example of a case where the toner 320-1 whose toner color is cyan (C) is detected as toner end or toner near end. When one of the other toners 320 is detected as toner end or toner near end, a portion "cyan" in the display may be changed to a toner color (for example, "magenta", "yellow", "black", etc.) of the one of the other toners 320. Also, when two or more of the toners 320 are detected as toner end or toner near end at the same time, two or more colors may be listed in the portion of displaying toner colors. For example, the toners of cyan and magenta are detected as toner near end at the same time, the portion of "cyan" may be changed to display as "cyan, magenta."

Also, on the toner replacement request screen, the button (software button on the touch panel) displayed as "OK" B101 is arranged. When a user presses the button B101, the display of the toner replacement request screen ends.

Figure 8:
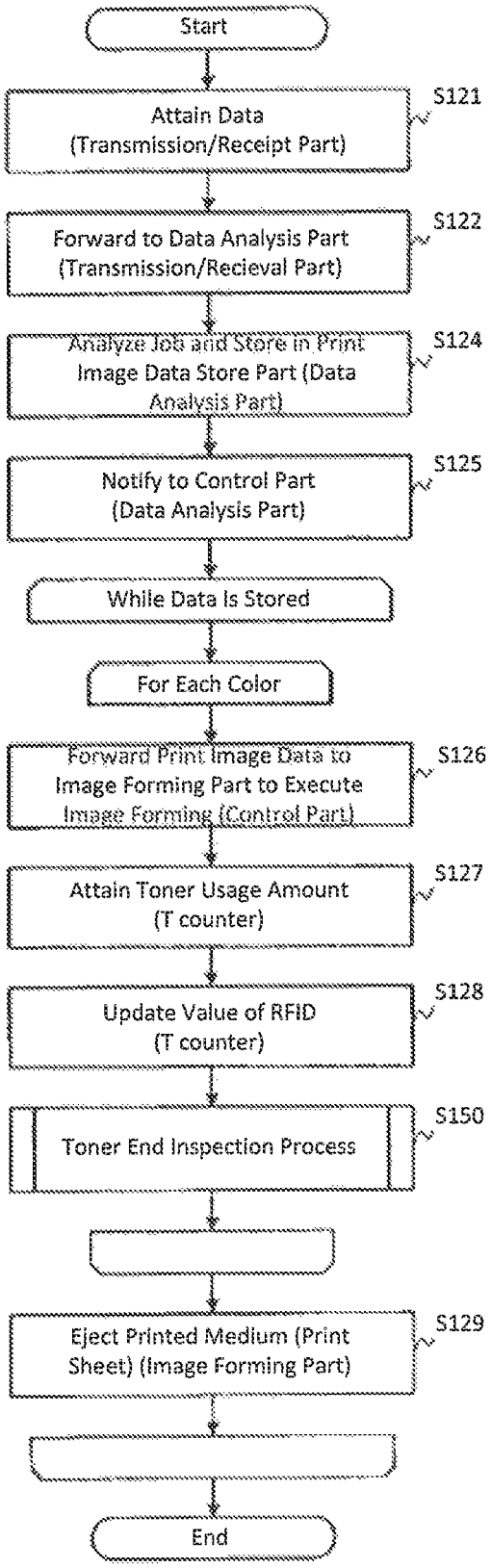
FIG. 8 is a flow diagram of a print process executed by a control part of the printer according to the first embodiment.

Next, an operation when the print process in S120 described above is executed in the printer 1 is explained using FIG. 8.

When the transmission/receipt part 110 attains print job data from the host of the transmission source of the print job (S121), the control part 200 forwards the date to the data analysis part 120 (S122).

Then, the data analysis part 120 creates print image data by analyzing the received data, stores in the print image data store part 130 (S124), and notifies to the control part 200 (S125).

Then, while the data is stored in the print image data store part 130, the control part 200 executes processes of S126 through 128 and S150, which will be described later, to the image forming part 300 (print units 310-1 through 310-4 of the toner colors of C, M, Y, and K).

Initially, while the control part 200 forwards the print image data from the print image data store part 130 to the image forming part 300, the control part 200 controls each of the print units 3101 through 310-4 configuring the image forming part 300, and executes image forming to a print sheet medium (S126).

Then, each of the T counters 430-1 through 430-4 respectively corresponding to the print units 310-1 through 310-4 calculates and attains an added value (added amount) of the toner usage amount used for the image forming at that time based on the image data supplied from the control part 200 to the print unit 310 corresponding to the T counter 430 (S 127). Note, the process of calculating the added value of the toner usage amount may be executed by the control part 200 side and be notified to each of the T counters 430-1 through 430-4.

Then, each of the T counters 430-1 through 430-4 executes a process of updating by adding the attained added value of the toner usage amount to the parameter of the toner usage amount recorded on the corresponding RFID 321 of the toner 320.

Then, when the control part 200 completes the update of the toner usage amount on the MID 321 of the toner 320, the toner 320 (320-1 through 320-4) of the toner color executes the toner end inspection process (the same process as S150 described above).

Then, when image forming by all of the print units 310-1 through 310-4 of the toner colors for one print sheet ends in the printer 1, the print sheet is ejected as a printed sheet (S129), and when image date still remains in the print image date store part 130, the operation returns to S126 described above and processes an operation of S 126. On the other hand, when the image date does not remain in the print image date store part 130, all image date has been already printed. Therefore, the control part 200 ends the print process for the print job. Note, when the toner end inspection process (S150) described above is executed during the print process, the judgment processes in both S156 and S164 are "Y."

Figure 9:
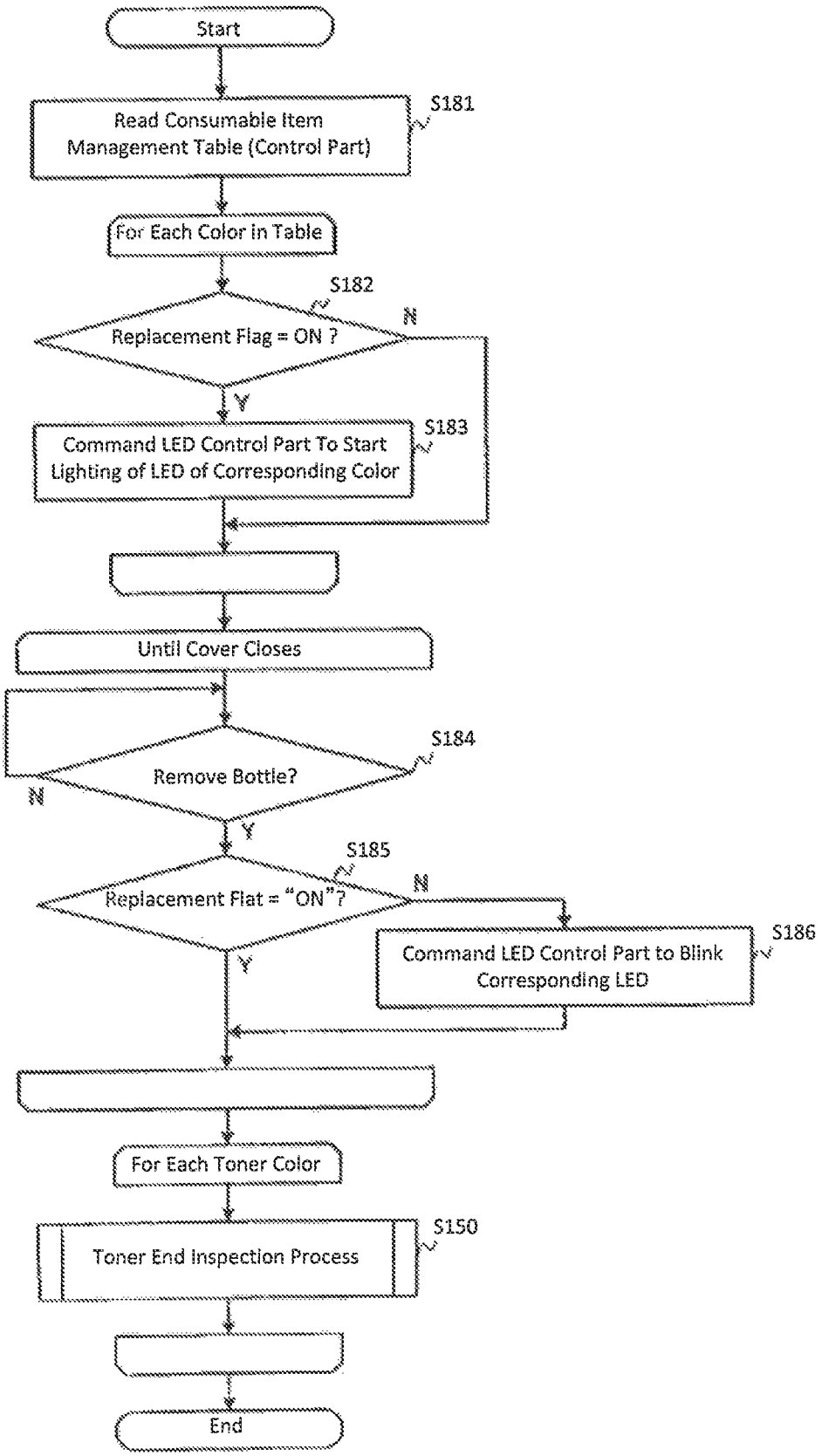
FIG. 9 is a flow diagram of a toner replacement management process executed by the printer according to the first embodiment.

Next, an operation in a case where the toner replacement management process (S180) described above is executed in the printer 1 is explained using FIG. 9.

When the cover-opened (opened state of the cover 160) is detected from the cover switch 150, the control part 200 starts the toner replacement management process and reads the content of the consumable item management table 210 (S181).

Then, the control part 200 executes a process of controlling the LED control part 410 so as to start lighting of the LED 420 corresponding to the toner 320 whose replacement flag is ON(1) in the consumable item management table 210 (S182, S183).

For example, when the replacement flag corresponding to the toner color C (cyan) is ON(1) in the consumable item management table 210, the control part 200 controls the LED control part 410 so as to start lighting of the LED 420-1 corresponding to the toner 320-1.

Then, the control part 200 executes processes of S184 through S186, which is described later, until the cover-closed (closed state of the cover 160) is detected from the cover switch 150.

When a removal of at least one of the toners 320 from the image forming part 300 is detected, the control part 200 confirms whether or not the replacement flag corresponding to the at least one of the toners 320 is ON(1) on the consumable item management table 210. When the replacement flag corresponding to the at least one of the toners 320 is not ON, the control part 200 executes a process of controlling the LED control part 410 such that the LED 420 corresponding to the at least one of the toners 320 blinks at a predetermined interval (S184-S186).

For example, when the toner 3202 corresponding to the toner color M is removed in a state where the replacement flag of the toner color M (magenta) is "0", which means OFF, on the consumable item management table 210, the control part 200 controls the LEI) control part 410 such that the LED 420-2 corresponding to the toner 320-2 blinks.

Note, a system how the control part 200 detects the removal of the toner 320 is not limited, but various configuration for a conventional printer is applicable. Note, in a case of a configuration in which the toner cartridge and the print unit (image forming part) are integrated, the control part 200 needs to detect the removal of the print unit including the toner cartridge.

Then, when the cover-closed (closed state of the cover 160) is detected from the cover switch 150, the control part 200 executes the toner end inspection process (process the same as S150 described above) for each of the toners 320-1 through 320-4 of the toner colors, and ends the process of the toner replacement management process.

(A-3) Effect of First Embodiment

According to the first embodiment, the following effects can be obtained.

In the printer 1, the LED 420 is arranged near the print unit 310 including the toner 320. When toner end or toner near end is detected, lighting of the LED 420 near the toner 320 is started during cover-opened. Therefore, it is possible to easily-visibly inform a user (for example, maintenance staff, etc.) of the toner 320 required to be replaced. Therefore, in the printer 1, this results in preventing the toner 320 that is not required to be replaced from mistakenly being replaced, and promoting efficient usage of the toner 320 by a user.

Also, in the printer 1, when the toner 320 whose toner usage amount is less than toner near end (in other words, the remaining amount of the toner does not reach near end) is removed, the LED 42.0 near the toner 320 blinks. Therefore, the user is dearly informed that there is no necessity to replace the toner 320, and the efficient usage of the toner 320 by a user can be promoted.

(B) Second Embodiment

Hereinafter, a detail description of an information processing apparatus and control program according to a second embodiment of the present application is given with reference to the drawings. Note, the information processing apparatus according to the second embodiment is a printer.

(B-1) Configuration of Second Embodiment

Figure 10:
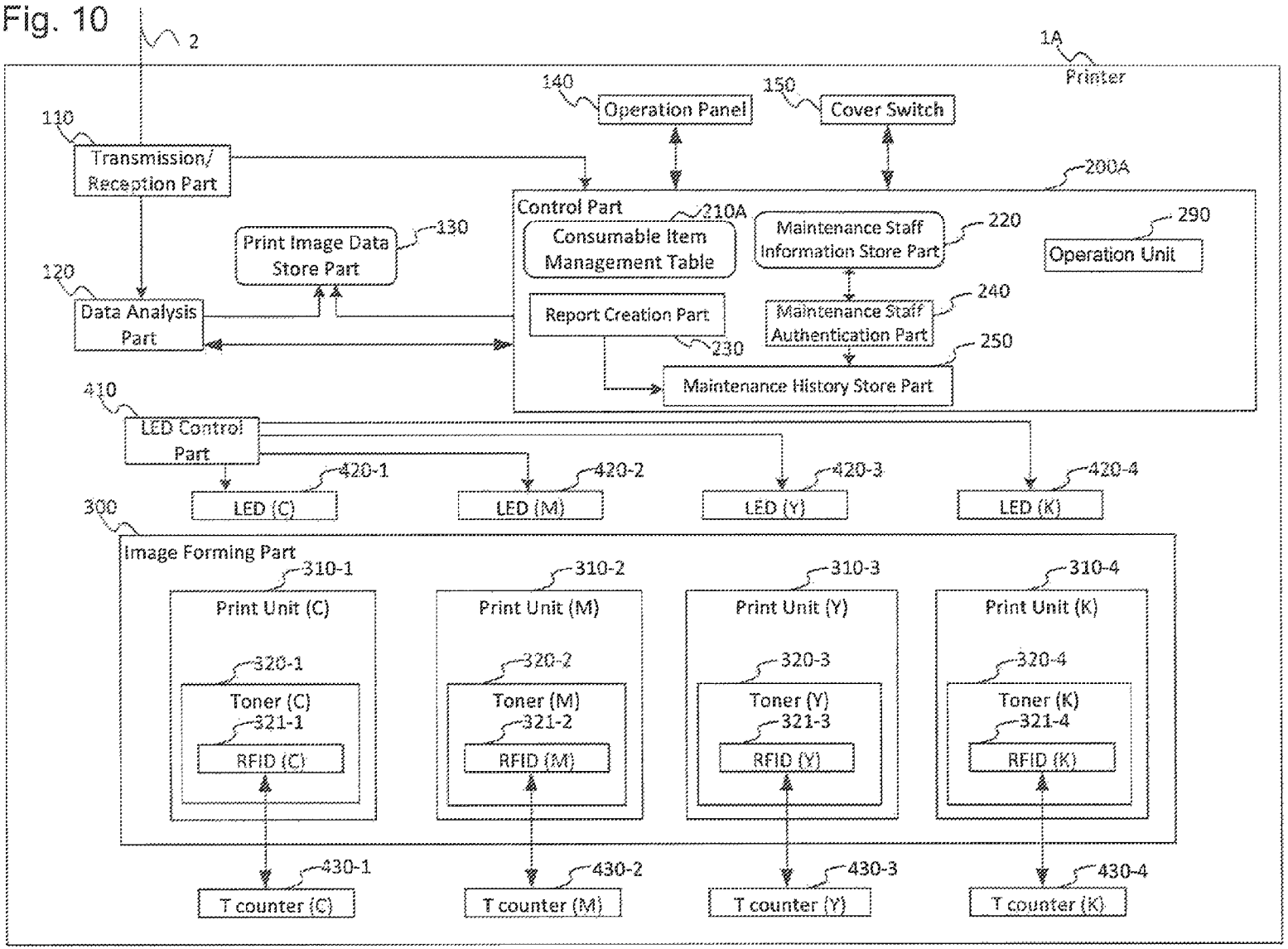
FIG. 10 is a block diagram of a functional configuration of a printer according to a second embodiment.

FIG. 10 is a block diagram of a functional configuration of a printer 1A according to the second embodiment, and the same or corresponding reference numbers are given to parts that are the same as or correspond to the parts illustrated in FIG. 1.

Hereinafter, the difference between the second embodiment and the first embodiment is mainly explained.

The printer 1A includes a control part 200A instead of the control part 200. Also, the control part 200A includes a consumable item management table 210A instead of the consumable item management table 210. Furthermore, the control part 200A is different from the first embodiment in that a maintenance staff information store part 220, a report creation part 230, a maintenance authentication part 240, and a maintenance history store part 250 are added.

Next, the consumable item management table 210A is explained.

Figures 16, 17, 18:
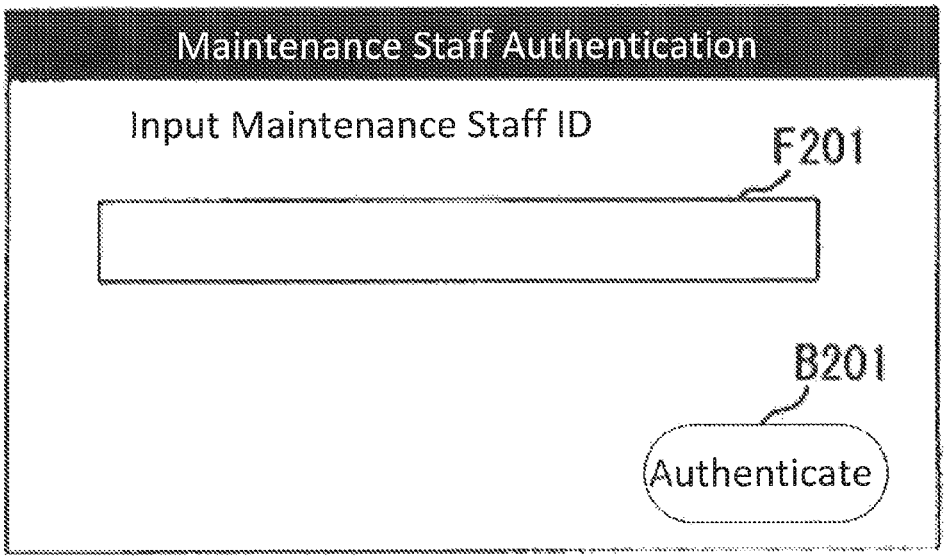
FIG. 16 is an explanatory view of a content example of a consumable item management table according to the second embodiment.
FIG. 17 is an explanatory view of a content example of a maintenance staff information management table stored in a maintenance staff information store part according to the second embodiment.
FIG. 18 is an explanatory view of an example of a maintenance staff authentication screen displayed and output by the printer according to the second embodiment.

FIG. 16 is an explanatory view of a content example of information recorded in the consumable item management table 210A.

In the consumable item management table 210A illustrated in FIG. 16, an item "RFID" is added. The RFID is the item for indicating a value of a toner usage amount at that point of the toner 320 of the toner color. This is the point different from the first embodiment. For example, in FIG. 16, the item REID for the toner color "C" is "2420." This indicates that the value of the toner usage amount recorded on the RFID 3211 of the toner 320-1 corresponding to the toner color "C" is "2420."

Next, the maintenance staff information store part 220 and the maintenance staff authentication part 240 are explained.

In the maintenance staff information store part 220, a table (hereinafter, referred to as "maintenance staff information management table") for managing information (hereinafter, referred to as "maintenance staff information") that includes information of each maintenance operation staff (for example, an operation staff who replaces a consumable item such as the toner 320) for the printer 1A is stored. The maintenance staff information registered in the maintenance staff information management table includes at least information necessary for an authentication process of the maintenance staff authentication part 240.

FIG. 17 is an explanatory view of a content example of the maintenance staff information management table stored in the maintenance staff information store part 220.

In the maintenance staff information in the maintenance staff information management table illustrated in FIG. 17, a maintenance staff ID (identification information of a maintenance staff) for each maintenance staff is recorded as minimum information necessary for the authentication process of the maintenance staff authentication part 240. Note, in the maintenance staff information management table, of each maintenance staff, a maintenance staff ID, a password for authentication, and a name of a maintenance staff may be recorded as maintenance staff information.

Then, when the maintenance staff authentication part 240 is activated in the control part 200A, the maintenance staff authentication part 240 displays a screen (hereinafter, referred to as "maintenance staff authentication screen") to allow a user (maintenance staff) to input authentication information on the operation panel 140, and executes a process of allowing a user (maintenance staff) to input the authentication information (maintenance staff ID). In other words, in the printer 1A, the control part 200A and the operation panel 140 also perform as authentication information input parts that allow a user (maintenance staff) to input authentication information (maintenance staff ID).

FIG. 18 is an explanatory view of a configuration example of the maintenance staff authentication screen.

In the maintenance staff authentication screen illustrated in FIG. 18, with a message of "input maintenance staff ID", a field F201 for inputting a maintenance ID and a button B201 displayed as "authenticate" are arranged.

When a maintenance staff ID is input in the field F201 by a user and the button B201 displayed as "authenticate" is pressed, the maintenance staff authentication part 240 checks the content input into the field F201 with the content of the maintenance staff information management table in the maintenance staff information store part 220. When identical information (maintenance staff ID) is detected, it is determined as authentication success. When identical information is not detected, it is determined as authentication failure. In other words, also in the printer 1A, the authentication part 200A also performs as an authentication processing part that executes the authentication process of a user (maintenance staff).

In the printer 1A, a part that allows a user (maintenance staff) to input a maintenance ID is not limited. For example, the maintenance staff ID may be input from software keys displayed on the operation panel 140 and may be input from hardware keys arranged.

Next, the maintenance history store part 250 is explained.

In the maintenance history store part 250, a maintenance history management table for managing information (hereinafter, referred to as "maintenance history information") regarding a maintenance history of a consumable item (in this embodiment, the toner 320) is stored.

FIG. 19 is an explanatory view of a content example of the maintenance history management table recorded in the maintenance history store part 250.

In the maintenance history management table, maintenance history information of each case of a consumable item replacement is registered, and each maintenance history information includes information for items of "toner color", "the number of outputable images", "count at the time of replacement", "authentication date", and "maintenance staff ID." In other words, the control part 200A executes a process of adding one case of maintenance history information at every time when a consumable item (one of the toners 320 in this embodiment) is replaced.

The item "toner color" indicates a toner color of the toner 320 that is a target to be replaced in the maintenance history information.

The item "the number of outputable images" indicates a toner near end value (the number of printable images) of the toner 320 that is a target to be replaced in the maintenance history information.

The item "count at the time of replacement" indicates a value (value in the item "RFID" in the consumable item management table) of a toner usage amount when the toner 320 that is a target to be replaced is replaced recorded on the RFID 321 in the maintenance history information.

The item "authentication date" indicates a date when the authentication process is executed in the maintenance staff authentication part 240 after adding the maintenance history information. In the maintenance history information just after a registration, dummy information is input in the authentication date. After that, when an authentication process is executed in the maintenance staff authentication part 240, a date when the authentication is executed is input in the item of authentication date in the maintenance history information. In other words, the control part 200A also performs as a replacement history information processing part that processes maintenance history information (replacement history information) based on an authentication result. The content of the dummy information is not limited. However, in this embodiment, data "9999/99/99" is input as the dummy information for the authentication date, In the maintenance history management table of the present embodiment, according to whether or not the item of authentication date is set as the dummy information the maintenance history information is determined whether or not it has been authenticated. And, another system (for example, a system of adding flag information for managing whether or not the information has been authenticated) may be used for managing whether or not the maintenance history information has been authenticated. In the application, the above information that has been authenticated is defined as "already-authenticated information."

When the authentication process is executed in the maintenance staff authentication part 240 (in the case of authentication success) after adding the maintenance history information, in the item "maintenance staff ID", the authentication information (maintenance staff ID) used for the authentication is input. In other words, in the maintenance history information just after the registration, the item of maintenance staff ID is blank. After that, when an authentication process is executed in the maintenance staff authentication part 240, authentication information (maintenance staff ID) used in the authentication process is input in the item of maintenance staff ID.

When a print process is executed, the control part 200A refers the maintenance history management table in the maintenance history store part 250. When maintenance history information includes the dummy information in the authentication date, a process of cancelling the print job is performed. In other words, the control part 200A is configured not to execute the print process when the maintenance history information includes the dummy information in the authentication date in the maintenance history management table. In other words, the control part 200A also performs as an operation limitation part that limits an operation of the printer 1A based on the content of the maintenance history management table of the maintenance history store part 250.

Next, the report creation part 230 is explained.

When the report creation part 230 is activated in the control part 200A, the report creation part 230 outputs a report (hereinafter, referred to as "Consumable Item Mangement Report") regarding a maintenance history of the printer 1A based on the maintenance history management table of the report creation part 230. A device or method from which the report creation part 230 outputs the consumable item management report is not limited. However, in this embodiment, a print output using the image forming part 300 is executed.

FIG. 20 is an explanatory view of a content example of the consumable item management report output by the report creation part 230.

The consumable item management report illustrated in FIG. 20 is an example in which the content of the maintenance history management table is output as it is. However, items of information included in the consumable item management report may be changed by addition or deletion, etc.

(B-2) Operation of Second Embodiment

Next, an operation of the printer 1A according to the second embodiment, which has the above-described configuration, is explained.

Figure 11:
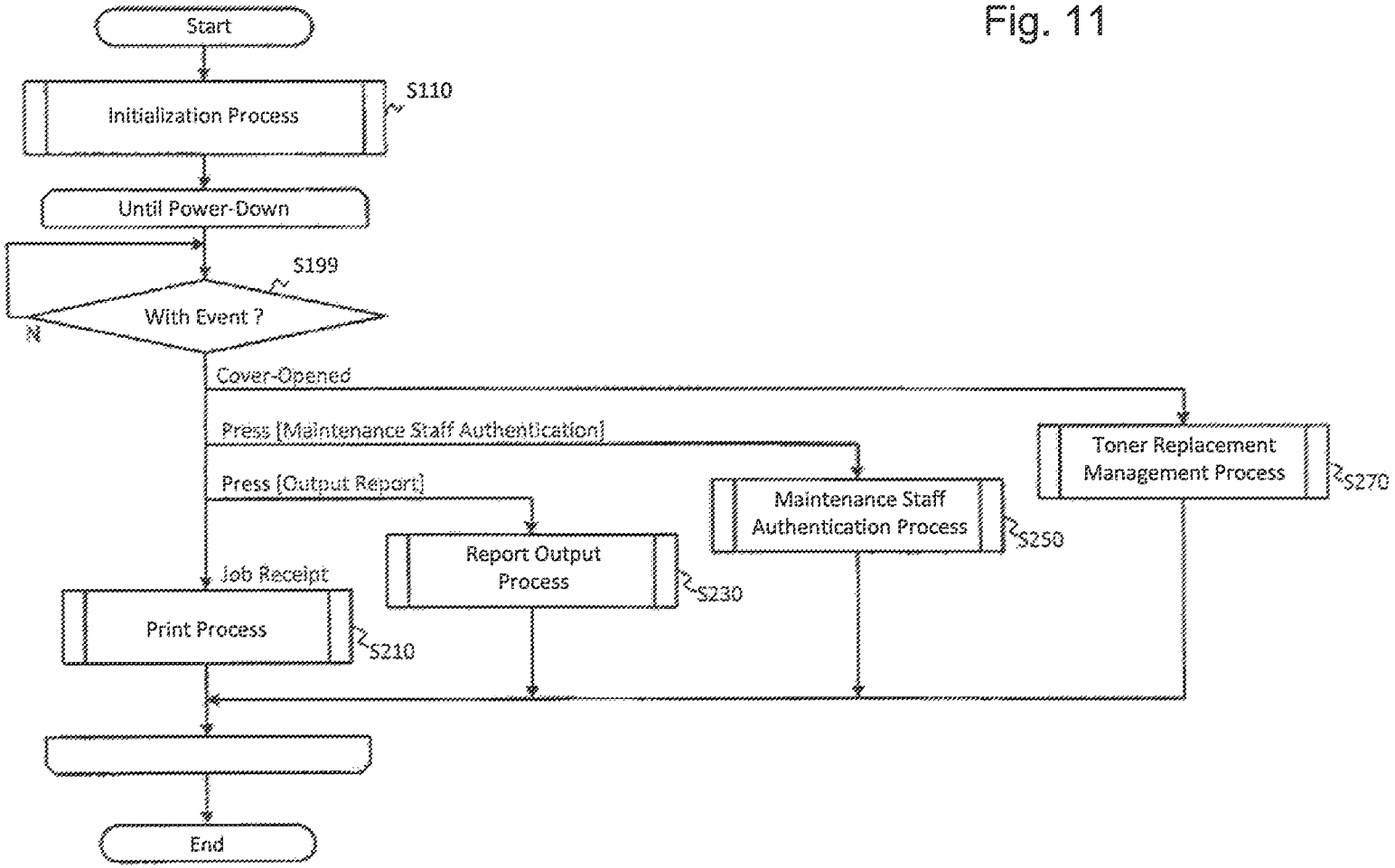
FIG. 11 is a flow diagram of entire processes for toner management executed by the printer according to the second embodiment.

FIG. 11 is a flow diagram of entire processes (processes executed by the control part 200A) for toner management of the printer 1A.

In response to power-up of the printer 1A, the control part 200A executes the initialization process (S110). Note, because the initialization process (S110) is the same as that of the first embodiment, a detail description thereof is omitted. Also, because the toner end inspection process (the above described step, S150) executed (called) in the initialization process (the above described step, S110) is the same as that of the first embodiment, a detail description thereof is omitted. In the toner end inspection process (the above described step, S150) of the second embodiment, the same process as that of the first embodiment is applicable except for that the content of "toner replacement request screen" output on the operation panel 140 in S155, S163, etc., which are described above, is different.

Figure 22:
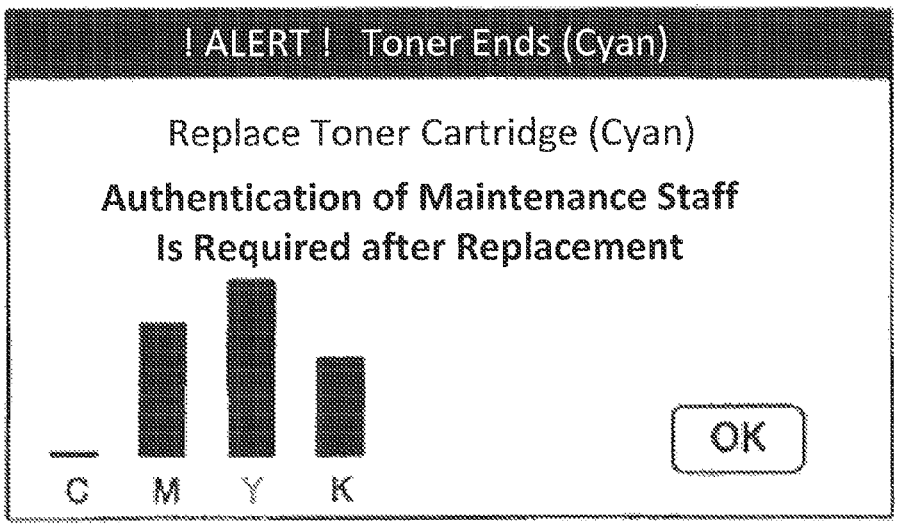
FIG. 22 is an explanatory view of an example of a toner replacement request screen displayed and output by the printer according to the second embodiment.

FIG. 22 is an explanatory view of a content of the "toner replacement request screen" displayed and output on the operation panel 140 of the second embodiment.

In the toner replacement request screen of the second embodiment, as illustrated in FIG. 22, a message "authentication of maintenance staff is required after replacement" is output. An alert telling that an authentication process by a maintenance staff is required to execute the print process is given.

Then, when an event occurs, the control part 200A executes a process corresponding to the event until power-down (S199).

The printer 1A executes a print process (S210) when an event of receiving a print job occurs. Also, the printer 1A executes a toner replacement management process (S270) When an event of cover-opened (detection of cover-opened from the cover switch 150) occurs.

Furthermore, when an event of a user operation occurs (for example, a predetermined. key is pressed on the operation panel 140), the printer 1A executes a maintenance staff authentication process (S250) and/or a report output process (S230) depending on the operation content.

Figure 21:
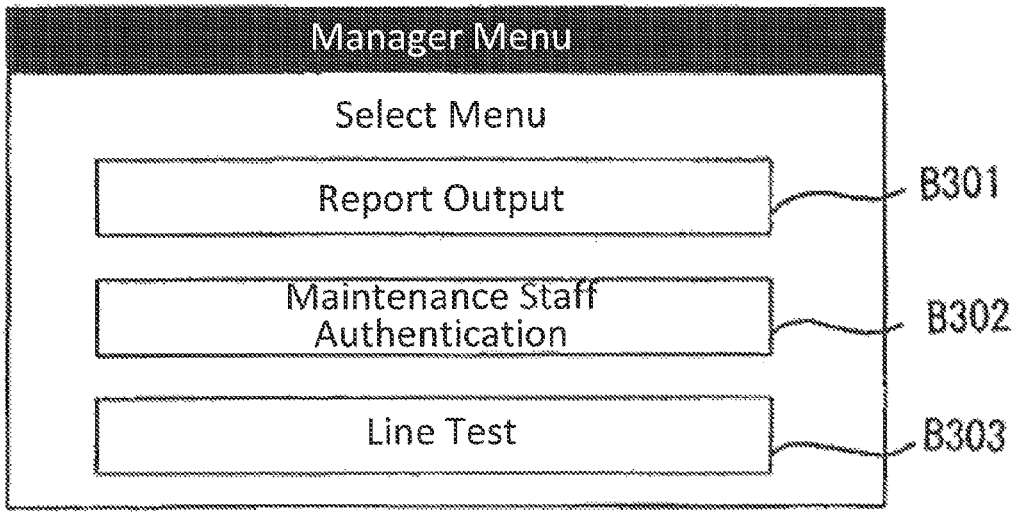
FIG. 21 is an explanatory view of an example of a manager menu screen displayed and output by the printer according to the second embodiment.

In the printer 1A, an operation content that is a trigger to start the maintenance staff authentication process (S250) and/or the report output process (S230) is not limited. In the printer 1A, When for example a button B301 displayed as "report output" on a manager menu screen (screen displayed on the operation panel 140) as illustrated in FIG. 21 is pressed, the report output process (S230) may start. Also, in the printer 1A, when a button B302 displayed as "maintenance staff authentication" on the manager menu screen as illustrated in FIG. 21 is pressed, the maintenance staff authentication process (S250) may start. Note, an operation in the printer IA to display the manager menu screen as illustrated in FIG. 21 is not limited. A configuration of a menu screen process used in a conventional printer, etc., is applicable.

Figure 12:
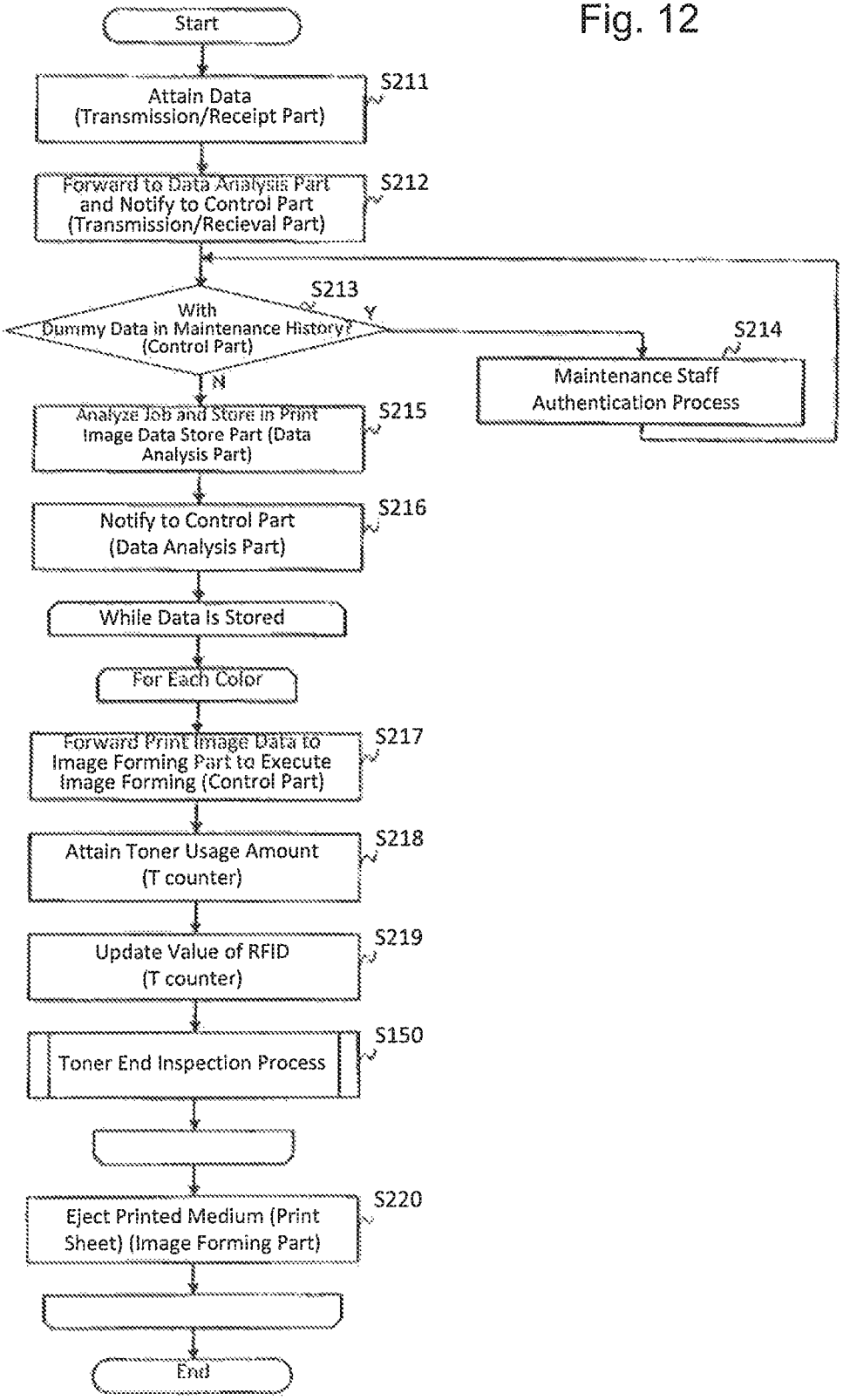
FIG. 12 is a flow diagram of a print process executed by a control part of the printer according to the second embodiment.

Next, an operation when the print process in S210 described above is executed in the printer 1A is explained using FIG. 12.

When the transmission/receipt part 110 attains print job data from the host of the transmission source of print job (S211), the control part 200A forwards the date to the data analysis part 120 (S212).

Then, the control part 200A refers maintenance history management data in the maintenance history store part 250, and executes a search of maintenance history information in which a dummy value is recorded in the authentication date (S213).

Then, when maintenance history information in which a dummy value is recorded in the authentication date is detected from the maintenance history management date in S213 described above, the control part 200A starts an operation thereof from S214 described later; and when that is not the case, the control part 200A processes an operation thereof from S215 described later.

Then, when maintenance history information in which dummy information is recorded in the authentication date is detected from the maintenance history management date in S213 described above, the control part 200A determines that maintenance history information without an authentication by a maintenance staff after consumable item replacement exists, activates the maintenance staff authentication part 240 and executes a maintenance staff authentication process (S214), and then goes back to S213 and processes an operation of S213 described above. In this case, the maintenance staff authentication process executed by the control part 200A is the same as the process executed in S250 described above. A detail thereof is described later.

On the other hand, when maintenance history information in which dummy information is recorded in the authentication date is not detected from the maintenance history management date in S213 described above, the data analysis part 120 analyzes the received data and creates print image data, and stores in the print image data store part 130 (S215) and notifies to the control part 200A (S216).

Then, the control part 200A executes operations of S217-219 and S150 described later to the image forming part 300 (the print units 310-1 through 310-4 of the colors of C, M, Y, and K) while the data exists in the print image data unit part 130. Note, the operations of S217-219 are the same as the operations of S126-128 in the first embodiment, so a detail description thereof is omitted. Also, a toner end inspection process of S150 is the same as the one described above, so a detail description thereof is omitted.

Then, when printings of all of the colors by the print units 310-1 through 310-4 on a print sheet end, the printer 1A ejects the print sheet as a printed sheet (S220). When image date still remains in the print image date store part 130, going back to S216 and processing an operation of S216 are performed.

Figure 13:
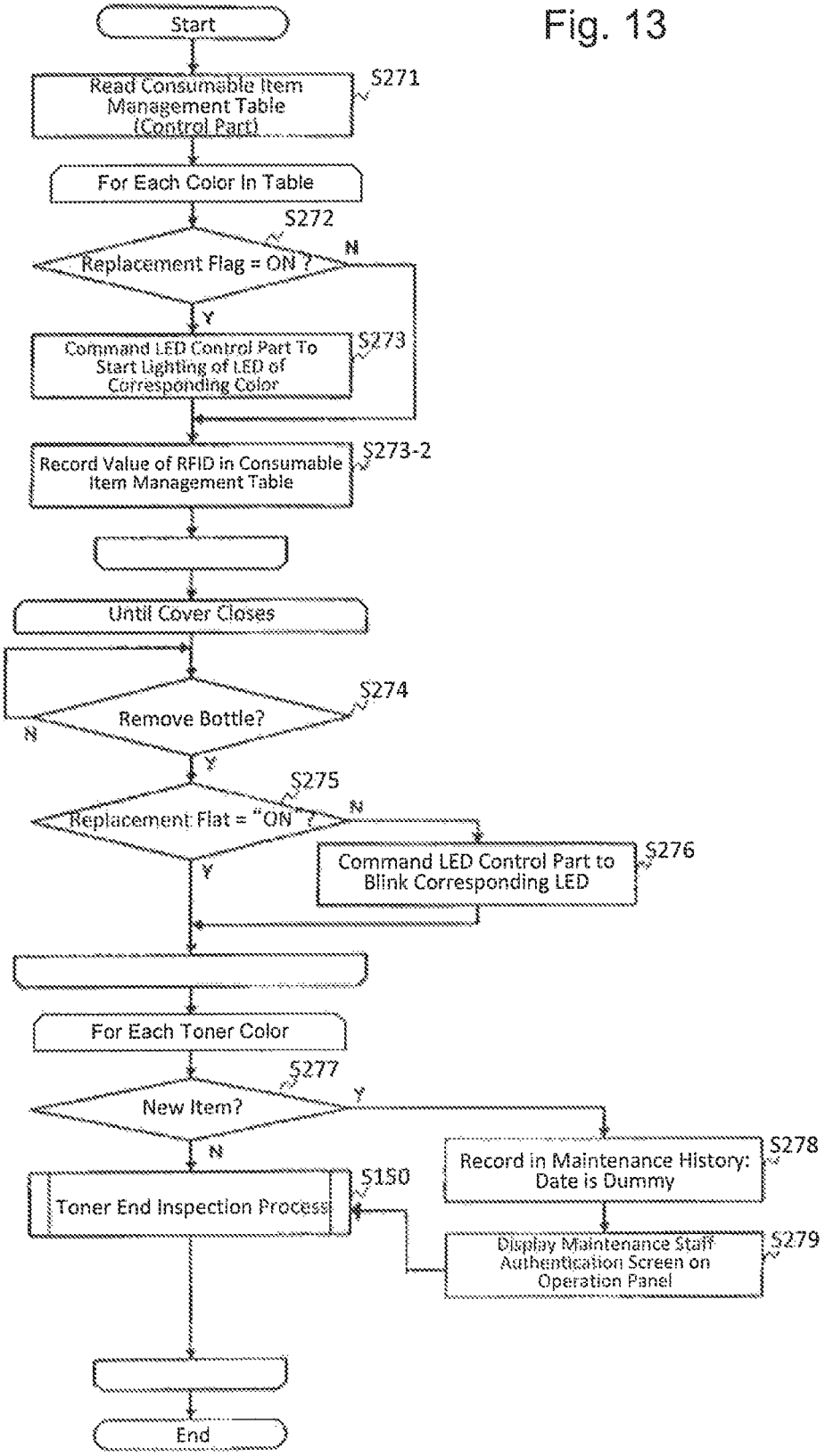
FIG. 13 is a flow diagram of a toner replacement management process executed by the printer according to the second embodiment.

Next, an operation for a case that the toner replacement management process of S270 described above is performed in the printer 1A is explained using FIG. 13.

When cover-opened (opened state of the cover 160) is detected from the cover switch 150, the control part 200A starts the toner replacement management process and reads a content of the consumable item management table 210 (S271).

Then, the control part 200A performs an operation of controlling the LED control part 410 so as to start lighting of the LED 420 corresponding to the toner 320 whose replacement flag is ON(1) on the consumable item management table 210 (S272, S 273).

Also, the control part 200A reads a value of a toner usage amount recorded on the RFID 321 of the toner 320 from the T counter 430, and updates a value in the item RPM of the consumable item management table 210A based on the read value (S273-2).

Then, the control part 200A performs operations of S274-S276 described later until cover-closed (closed state of the cover 160) is detected from the cover switch 150. Note, the operations of S274-S276 are the same as the operations of S184-S186 in the first embodiment, so a detail description thereof is omitted.

Then, cover-closed (closed state of the cover 160) is detected from the cover switch 150, the control part 200A confirms whether or not the toners 320-1 through 3204 are new (unused) toners (S277), and performs S278 and S279 described later only for one or more of the toners 320 confirmed as a new (unused) toner.

When the toner 320 is confirmed as a new toner in S277 described above, the control part 200A generates maintenance history information that the toner 320 has been replaced and adds/registers to the maintenance history management table of the maintenance history store part 250 (S278).

In this case, the control part 200A generates maintenance history information: information (one of C, M, Y, and K) to indicate a toner color of the toner 320 in the item "toner color"; a value of "the number of printable images" regarding a pre-replacement toner 320 recorded on the consumable item management table 210A in the item "the number of outputable images"; a value of "RFID" regarding the pre-replacement toner 320 recorded on the consumable item management table 210A in the item "count at the time of replacement"; dummy information "9999/99/99" in the authentication date; no information (blank) in the authentication ID.

A method how the control part 200A confirms whether or not the toner 320 is a new toner is not limited, However, for example, the control part 200A may determine based on the value of the toner usage amount recorded on the RFID 321. For example, when the value of the toner usage amount recorded on the RFID 321 is zero, the toner 320 is recognized as a new toner.

For example, a case where the content of the consumable item management table 210A is the content illustrated in FIG. 16 and where the toner 320-1 is replaced and is confirmed as a new toner is supposed. In this case, as illustrated in FIG. 19 (bottom row), the control part 200A generates and adds maintenance history information that has "C" in the item "toner color", "2500" in the item "the number of outputable images", "2420" in the item "count at the time of replacement", dummy information "9999/99/99" in authentication date, and no information (blank) in maintenance staff ID.

Then, the control part 200A activates the maintenance staff authentication part 240 and executes the maintenance staff authentication process (S279), In this case, the maintenance staff authentication process executed by the control part 200A is the same as the process of S250 described above, so a detail description thereof is given later. Note, the control part 200A may performs the operations of S278 and S279 without confirming whether or not a newly attached toner 320 is a new toner.

Then, the control part 200A executes a toner end inspection process (the same process as S150) for each of the toners 320-1 through 3204, and ends the operation of the toner replacement management process.

Figure 14:
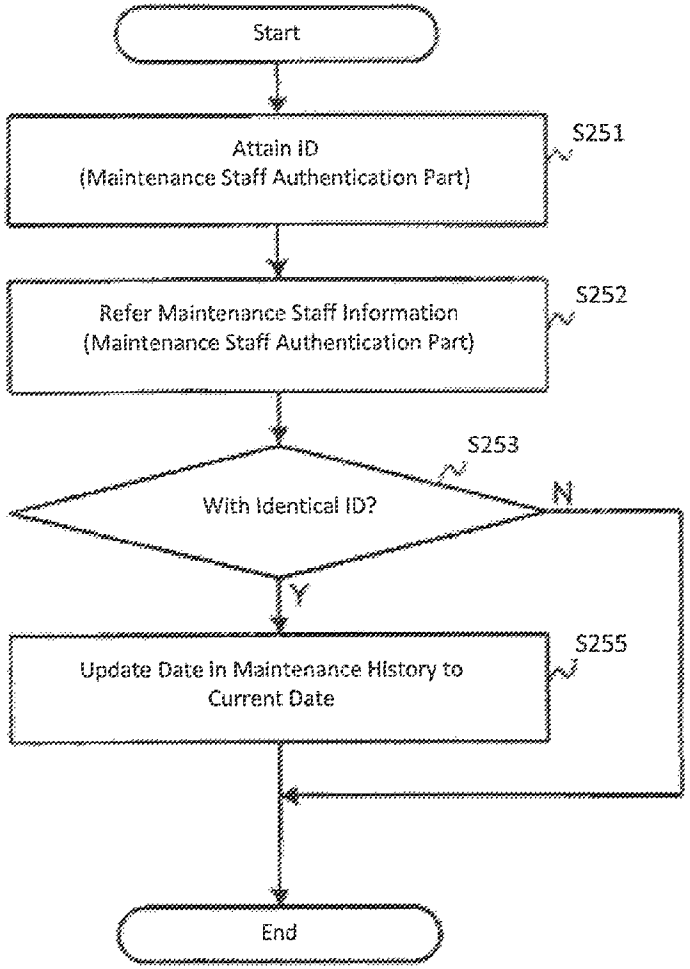
FIG. 14 is a flow diagram of a maintenance staff authentication process executed by the printer according to the second embodiment.

Next, an operation for a case Where the maintenance staff authentication process in S250, etc. described above in the printer 1A is explained using FIG. 14.

When the maintenance staff authentication process starts, the maintenance staff authentication part 240 is activated in the control part 200A. Then, the maintenance staff authentication part 240 outputs the maintenance staff authentication screen (screen to request a user to authenticate, see FIG. 18 described above) on the operation panel 140 to allow a user (maintenance staff) to input authentication information (maintenance staff ID), and attains the input authentication information (maintenance staff ID) (S251).

Then, the maintenance staff authentication part 240 refers information registered in the maintenance staff information store part 220 (S252), and confirms Whether or not information identical to the input authentication information (maintenance ID) is registered (S253).

Then, when identical information is detected from the maintenance staff information store part 220 in S252 described above, the maintenance staff authentication part 240 determines as authentication success. Then, in a case of authentication success, the control part 200A updates maintenance history information including dummy information (9999/99/99) in the item "authentication date" in the maintenance history store part 250 to a current date, performs a process of updating information in the item "maintenance staff ID" in the maintenance history information to a maintenance staff ID has been used for the authentication (S255), and ends the maintenance staff authentication process.

On the other hand, when identical information is not detected from the maintenance staff information store part 220 in S252 described above, the maintenance staff authentication part 240 determines as authentication failure. Then, the control part 200A ends the maintenance staff authentication process. Note, in this case, the operation may starts its performance from S251 described above again, and may retry (may be with a predetermined limited number of times) the authentication process.

Figure 15:
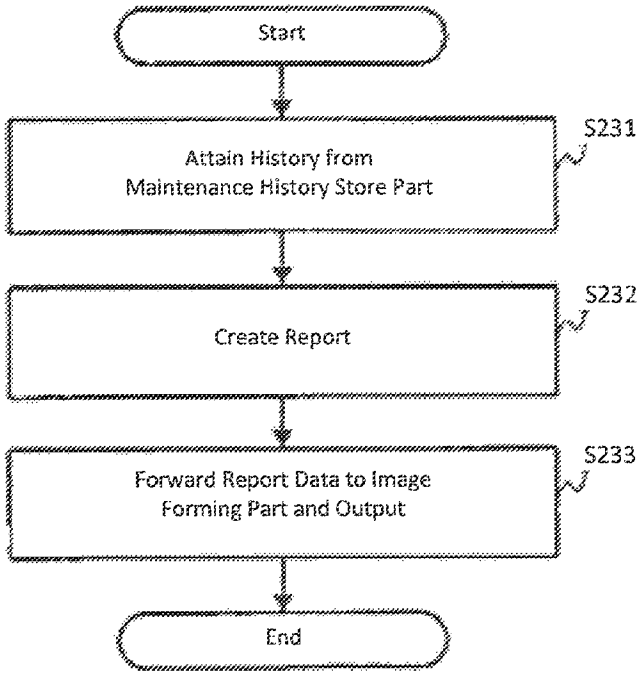
FIG. 15 is a flow diagram of a report output process executed by the printer according to the second embodiment.

Next, an operation for a case where the report output process in S230 described above is performed in the printer 1A is explained using FIG. 15.

When the report output process starts, the control part 200A reads information in the maintenance history store part 250 (S231), and creates a report (for example, generates image date having a content illustrated in FIG. 20) (S232).

Then, the control part 200A stores the image date of the created report in the print image date store part 130, makes the image forming part 300 to executes the print process to a print sheet (S233), and ends the report output process.

(B-3) Effect of Second Embodiment

According to the second embodiment, the following effects can be obtained in addition to the effects of the first embodiment.

In the printer 1A, a maintenance staff ID of a maintenance staff who replaces a toner 320 (consumable item) can be recorded in the maintenance history store part 250 and report output can be performed as needed. Therefore, in the printer 1A, whether or not a replacement of a consumable item is properly performed can be recorded and confirmed, And also, since an operation history of a maintenance staff remains, this promotes the maintenance staff to endeavor to perform a proper maintenance operation with more attention. In other words, in the printer 1A, by storing and recording the maintenance history information in the maintenance history store part 250, replacement operation of a maintenance staff can be monitored. As a result, efficient replacement of a consumable item (toner 320) is promoted to a maintenance staff.

Also, since the image forming process is not executed until authentication of a maintenance staff who performed a replacement is performed after the replacement of a consumable item in the printer 1A, a person who replaces a consumable item (toner 320) can be properly recorded (monitored).

(C) Another Embodiment

The present application is not limited to the above-described embodiments, and a modified embodiment exemplified below can be also given.

(C-1) In the above-described embodiments, examples in which a printer is applied as an information processing apparatus of the present application have been given. However, an image forming apparatus having a plurality of other consumable items may be applied as the information processing apparatus of the present application. For example, in the printer of the above described embodiments, toner is used as a developer. However, other developer such as ink solution, etc. may be used. Also, in the above-described embodiments, the examples in which. a printer is applied to the present application have been explained. However, another image forming apparatus (for example, multifunction machine (MFP), facsimile, copier, etc.) may also be applied.

Also, in the above-described embodiments, the examples in which the information processing apparatus of the present application is applied to a printer have been given. However, the information processing apparatus of the present application can be applied to another information processing apparatus having a plurality of other consumable items. For example, a storage device (for example, storage device having a N+1. configuration such as RAID configuration) having a plurality of hard disk drives (HDD) may be applied as the information processing apparatus of the present application. The plurality of HDDs has substantially the same configuration. Hereinafter, for the sake of simple description, the HDDs may be described in singular mode, but it should be noted that a description of one of the HDDs in singular mode is also applied to the other HDDs. The HDD along with a mechanical rotation operation may be broken due to abrasion, etc., when an operation (recording/writing of data) is repeated over a predetermined time. The storage device having the N+1 configuration can continue its operation properly with one broken HDD, but cannot continue its operation when more than two HDDs are simultaneously broken. And, restoring saved date becomes difficult. Therefore, when one HDD is broken, a plurality of HDDs may have been replaced as a preventive maintenance. Therefore, a configuration for managing the HDDs in the above-described storage device in the same system as the one for the toner of the printer in the above-described embodiments may be applied. For example, in the above-described storage device, a total value of reading amount and writing amount of date of the HDD may be managed as a usage amount (consumption amount) of the HDD, and an operation of starting a lighting of a LED arranged near the HDD at a stage when the usage amount of the HDD reaches a predetermined value (near end value) may be performed. Also, for example, in a case of a replacement of a HDD in the above-described storage device, an operation may be performed to limit such that an operation of the storage device does not start unless maintenance history information is stored and a maintenance staff authentication process is performed in the same way as the second embodiment.

Moreover, in the above-described embodiment, the toner (toner cartridge) has been explained as a consumable item that is a target to be managed. However, another consumable item (for example, developer ink, ink ribbon, photosensitive drum, fuser, belt, etc) used in another printer may be managed.

(C-2) In the above-described embodiments, the toner usage amount is managed by the RFID attached to the toner. However, the system of managing the usage amount of the toner is not limited to the system using the RFID. For example, an IC chip, etc. in which an identification ID (hereinafter, referred to as "toner identification ID") is memorized may be attached to the toner, and the toner usage amount for each toner identification ID may be managed at the printer main body side. Also, in the printer of the present application, all toner newly replaced may be simply treated as a new toner without managing the toner usage amount for each toner.

(C-3) In the above-described embodiments, the example in which the toner replacement management process is performed in a state of power-up of the printer is explained. However, in an actual maintenance operation, a replacement may be performed during power-down of the printer. Therefore, a configuration is also applicable in which a battery or a storage battery necessary for driving the LED and the LED control part is provided and a lighting control of the LED can be performed based on the content of the consumable item management table even during power-down of the printer. In that case, at least information of the replacement flag of the consumable item management table should be memorized in the LED control part.

Also, the printer of the above-described embodiments executes the toner replacement management process only during cover-opened. However, the process may be executed in another time not during cover-opened. In other words, a timing to perform the toner replacement management process is not limited.

(C-4) in the second embodiment, in the same way as the first embodiment, the LED corresponding to the toner (print unit) is arranged and a lighting control is performed by the LED control part. However, the LED and the configuration for the lighting control of the LED may be omitted.

(C-5) In the second embodiment, the maintenance staff authentication part and the maintenance staff information store part are provided in the printer. However, the authentication may be performed by an external authentication device (authentication server).

(C-6) On the above-described embodiments, the control part determines whether or not a replacement of a toner is required based on the toner usage amount (consumption amount), However, in the same way as the technology disclosed in JP Laid-Open Patent Application No. 2007-17724, a judgment of whether or not a replacement of a toner is required may be also performed considering the remaining amount the toner.

Also, in the above-described embodiments, the value of the toner usage amount recorded on the RFID of the toner is obtained by adding values calculated at the time of printing in the printer (control part). However, with consideration of another factor, the value of the toner usage amount recorded on the RFID may be corrected.

For example, in a case where a sensor for detecting whether or not the remaining amount of the toner is the determined value or less (for example, toner near end value or less) is provided, the control part may determine the toner usage amount (for example, determine the predetermined toner near end value) to be recorded on the RFD of the toner with consideration of a result of the detection by the sensor. As the sensor to detect whether or not the remaining amount of the above-described toner is the predetermined value or less, various types of a sensor (for example, sensor that performs optical detection, etc.) used for a conventional toner (toner cartridge) is applicable.

(C-7) In the above-described embodiments, the LED is arranged in the outside (printer main body) of the image forming part (print unit). However, the LED may be arranged in the image forming part (for example, on a surface of the print unit).

What is claimed is:

1. An information processing apparatus, comprising:

a maintenance staff information store part that stores maintenance staff identification information;

a maintenance staff authentication part that determines an authentication success when identification information, which is input from an operation panel, is identical to the maintenance staff identification information;

a maintenance history store part that, when a replacement of a consumable item is performed at every time, stores the maintenance staff identification information as well as information of the consumable item that was used before the replacement, and the stored maintenance staff indication information is related to the information of the consumable item;

an output part that outputs the maintenance staff identification information that was authenticated at the time of the replacement of the consumable item used before the replacement as well as the information of the consumable item that is stored in the maintenance history store part, the consumable item being used before the replacement; and a first operation limitation part that limits executing a print process, wherein the first operation limitation part checks a relation between the information of each consumable item and the maintenance staff indication information in the maintenance history store part when a print job is received, and limits executing the print process when the first operation limitation part decided there is no relation between the information of one of the consumable items and the maintenance staff indication information.

2. The information processing apparatus according to claim 1, wherein the information of the consumable item, which is stored in the maintenance history store part, is defined based on a usage value of the consumable item that was used before the replacement.

3. The information processing apparatus according to claim 2, wherein the consumable item is toner, and the information of the consumable item relates to a value of a toner usage amount stored in an RFID that is disposed in correspondence to the consumable item.

4. The information processing apparatus according to claim 1, wherein:

the consumable item is configured with a plurality of consumable items, the maintenance history store part that, when a replacement of one of the consumable items is performed, stores the maintenance staff identification information as well as the information of the consumable item that was replaced; and the output part that outputs the maintenance staff identification information that was authenticated as well as the information of the consumable item that was replaced.

5. The information processing apparatus according to claim 1, wherein the information of the consumable item, which is stored in the maintenance history store part, is defined based on a remaining amount of the consumable item that was used before the replacement.

6. The information processing apparatus according to claim 5, wherein the consumable item is toner, and the information of the consumable item relates to a number of printable sheets with the remaining of the toner.

7. An information processing apparatus according to claim 1, further comprising:

a consumable item management part that manages either a consumption amount or a remaining amount of each of the consumable items;

a replacement necessity determination part that determines necessity of replacement of each of the consumable items based on either the consumption amount or the remaining amount of each of the consumable items managed by the consumable item management part;

a removal detection part that detects replacement of one of the consumable items;

a replacement history information store part that stores replacement history information regarding the replacement detected by the removal detection part, and the replacement history information includes maintenance staff identification information and information of the consumable item that was used before the replacement, and the stored maintenance staff identification information is related to the information of the consumable item;

an authentication information input that receives authentication information from a user;

an authentication processing part the performs a user authentication process using the authentication information received at the authentication information input part;

a replacement history information processing part that performs a process on replacement history information stored in the replacement history information stored part when the authentication by authentication processing part is succeeded; and a second operation limitation part that does not execute an operation of the information processing apparatus when, among replacement history information stored in the replacement history information store part, unprocessed replacement history information exists in the replacement history information store part as a result of a failed authentication with reference to the maintenance staff identification information that is registered in the replacement history information store part.

8. The information processing apparatus according to claim 7, wherein the consumable item management part that manages both the consumption amount and the remaining amount of each of the consumable items, and the replacement necessity determination part that determines the necessity of replacement based on both the consumption amount and the remaining amount.

9. The information processing apparatus according to claim 7, wherein when the authentication by the authentication processing part is succeeded, the replacement history information processing part performs a recording process of already-authenticated information, which indicates that it has been authenticated.

10. The information processing apparatus according to claim 7, further comprising:

a replacement history information output part that outputs the replacement history information stored in the replacement history information processing part.

11. The information processing apparatus according to claim 9, further comprising:

a replacement history information output part that outputs the replacement history information stored in the replacement history information processing part.

12. A control program stored in a non-transitory storage medium that allows a computer installed in an information processing apparatus including a plurality of detachable consumable items to performs as:

a consumable item management part that manages either a consumption amount or a remaining amount of each of the consumable items;

a replacement necessity determination part that determines necessity of replacement of each of the consumable items based on either the consumption amount or the remaining amount of each of the consumable items managed by the consumable item management part;

a removal detection part that detects replacement of each of the consumable items;

a replacement history information store part that stores replacement history information regarding the replacement detected by the removal detection part, and the replacement history information includes maintenance staff identification information and information of the consumable item that was used before the replacement, and the stored maintenance staff identification information is related to the information of the consumable item;

an authentication information input that receives input of the authentication information from a user;

an authentication processing part the performs a user authentication process using authentication information received at the authentication information input part;

a replacement history information processing part that performs a process on replacement history information stored in the replacement history information stored part when the authentication by authentication processing part is succeeded;

a first limits executing a print process; and a second operation limitation part that does not execute an operation of the information processing apparatus when, among replacement history information stored in the replacement history information store part, unprocessed replacement history information exists in the replacement history information processing part as a result of a failed authentication with reference to the maintenance staff identification information that is registered in the replacement history information store part, wherein the first operation limitation part checks a relation between the information of each consumable item and the maintenance staff indication information in the maintenance history store when a print job is received, and limits executing the print process when the consumable items and the maintenance staff indication information.

* * * * *